US007649508B2

(12) United States Patent
Yang et al.

(10) Patent No.: US 7,649,508 B2
(45) **Date of Patent: *Jan. 19, 2010**

(54) PLASMA DISPLAY APPARATUS AND DRIVING METHOD THEREOF

(75) Inventors: Heechan Yang, Busan (KR); Yunkwon Jung, Gumi-si (KR); Jinyoung Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 738 days.

This patent is subject to a terminal disclaimer.

(21) Appl. No.: 11/289,606

(22) Filed: Nov. 30, 2005

(65) Prior Publication Data

US 2006/0114187 A1 Jun. 1, 2006

(30) Foreign Application Priority Data

Dec. 1, 2004 (KR) ..... 10-2004-0100092
Dec. 1, 2004 (KR) ..... 10-2004-0100093

(51) Int. Cl.
*G09G 3/28* (2006.01)

(52) U.S. Cl. ..... 345/60; 345/67; 345/69; 345/65; 345/63

(58) Field of Classification Search ..... 345/60–69, 345/173, 208, 211; 315/169.1–169.4; 313/582
See application file for complete search history.

(56) References Cited

U.S. PATENT DOCUMENTS 3,765,011 A * 10/1973 Sawyer et al. ..... 345/60
4,030,091 A * 6/1977 Ngo ..... 345/68
5,990,630 A * 11/1999 Nakamura ..... 315/169.4
6,175,192 B1 * 1/2001 Moon ..... 315/169.3
6,414,658 B1 * 7/2002 Tokunaga ..... 345/63
6,483,487 B2 * 11/2002 Iseki ..... 345/60
6,529,177 B2 * 3/2003 Nakamura ..... 345/60
7,009,602 B2 * 3/2006 Nakamura ..... 345/209
RE39,236 E * 8/2006 Imamura ..... 345/211
2001/0024179 A1 * 9/2001 Nakamura ..... 345/60

(Continued)

FOREIGN PATENT DOCUMENTS

EP 1 630 775 A1 3/2006

(Continued)

OTHER PUBLICATIONS

Chinese Office Action dated Nov. 28, 2008.

(Continued)

*Primary Examiner*—Prabodh M Dharia
(74) *Attorney, Agent, or Firm*—KED & Associates, LLP

(57) ABSTRACT

A plasma display apparatus may be provided that reduces a noise generating in a waveform applied to a scan electrode or a sustain electrode and that stabilizes address discharge by improving applying time point of a waveform applied in an address period, so that driving stability of a panel may increase. The plasma display apparatus may include a plasma display panel in which a plurality of scan electrodes and a plurality of address electrodes intersecting the scan electrodes are formed, and a data driver dividing the address electrode into a plurality of electrode groups, corresponding to a scan waveform applied to the scan electrode, and the data driver applying an address waveform to one address electrode group, and the address waveform having an applying time point that is different from an applying time point of the scan waveform.

20 Claims, 21 Drawing Sheets

U.S. PATENT DOCUMENTS

| | | | | |
|---|---|---|---|---|
| 2002/0015012 | A1* | 2/2002 | Nakamura | 345/60 |
| 2004/0251830 | A1* | 12/2004 | Nagao et al. | 313/582 |
| 2005/0067961 | A1* | 3/2005 | Nakamura | 313/582 |
| 2005/0068266 | A1* | 3/2005 | Sano et al. | 345/60 |
| 2005/0077836 | A1* | 4/2005 | Jin et al. | 315/169.4 |
| 2006/0044221 | A1* | 3/2006 | Kim et al. | 345/60 |
| 2006/0103593 | A1* | 5/2006 | Jung et al. | 345/60 |
| 2006/0103594 | A1* | 5/2006 | Kim et al. | 345/60 |
| 2006/0114178 | A1* | 6/2006 | Yang et al. | 345/60 |
| 2006/0125725 | A1* | 6/2006 | Yang et al. | 345/67 |

FOREIGN PATENT DOCUMENTS

| | | |
|---|---|---|
| EP | 0 853 306 B1 | 4/2006 |
| EP | 0 837 443 B1 | 6/2006 |
| JP | 08-305319 | 11/1996 |
| JP | 10-091117 | 4/1998 |
| JP | 2001-272948 | 10/2001 |
| JP | 2003-122295 | 4/2003 |
| JP | 2004-047505 | 2/2004 |

OTHER PUBLICATIONS

European Search Report dated Dec. 27, 2007.
Chinese Office Action dated Feb. 1, 2008.
Korean Search Report dated Sep. 3, 2007.

* cited by examiner

PLASMA DISPLAY APPARATUS AND DRIVING METHOD THEREOF

This Nonprovisional application claims priority under 35 U.S.C. §119(a) on Patent Application Nos. 10-2004-0100092 and 10-2004-0100093 filed in Korea on Dec. 1, 2004, the entire contents of which are hereby incorporated by reference.

BACKGROUND OF THE INVENTION

1. Field of the Invention

The present invention relates to a plasma display apparatus, and more particularly, to a plasma display apparatus which reduces a noise generating in a waveform applied to a scan electrode or a sustain electrode and stabilizes address discharge by improving applying time point of a waveform applied in an address period, so that driving stability of a panel increases and a driving method thereof.

2. Description of the Background Art

In general, a plasma display apparatus comprises a plasma display panel in which barrier ribs formed between a front panel and a rear panel form a unit cell. Main discharge gas such as Neon (Ne), Helium (He), or mixed gas (Ne+He) of Neon and Helium and inert gas containing a small amount of Xenon fill each cell. When discharge is performed by a high frequency voltage, the inert gas generates vacuum ultraviolet rays and allows a phosphor formed between the barrier ribs to emit light, and thus an image is embodied. Such a plasma display apparatus is made to be thin and light, so that it has been in the spotlight as a next generation display device.

FIG. 1 illustrates a structure of a general plasma display panel.

As shown in FIG. 1, in a plasma display panel, a front substrate 100 in which a scan electrode 102, a sustain electrode 103, an upper dielectric layer 104, a protective layer 105 are formed in a front glass 101 that is a display surface in which an image is displayed and a rear substrate 110 in which a barrier rib 112, an address electrode 113, a phosphor 114, a lower dielectric layer 115 are formed in a rear glass 111 forming a rear surface are coupled to each other.

FIG. 2 illustrates a method of embodying an image gray level of a conventional plasma display apparatus.

As shown in FIG. 2, a conventional method of expressing an image gray level of a plasma display apparatus divides one frame into several subfields having the different number of light emitting. Each subfield is again sub-divided into a reset period (RPD) for initializing all cells, an address period (APD) for selecting a cell to be discharged, and a sustain period (SPD) for embodying a gray level depending on the number of discharge.

The sustain period increases in the ratio of $2^n$ (n=0, 1, 2, 3, 4, 5, 6, 7) in each subfield. The sustain period changes in each subfield and thus a gray level of an image can be expressed by adjusting a sustain period of each subfield, that is, the number of sustain discharge.

FIG. 3 illustrates a driving waveform of the conventional plasma display apparatus.

As shown in FIG. 3, the conventional plasma display apparatus is divided into a reset period, an address period, a sustain period, and an erasing period for erasing wall charges within the discharged cell and driven.

Referring to FIG. 3, in a driving waveform of the conventional plasma display apparatus, all address waveforms applied to the address electrode in the address period and a scan waveform applied to the scan electrode are applied at the same time. If the address waveforms and the scan waveform are applied to the address electrodes (X1 to Xn) and the scan electrode (Y), respectively, at the same time point, a noise is generated in the waveform applied to the scan electrode and the waveform applied to the sustain electrode.

SUMMARY OF THE INVENTION

Accordingly, an object of the present invention is to solve at least the problems and disadvantages of the background art.

An object of the present invention is to provide a plasma display apparatus which reduces generating of a noise by adjusting an applying time point of an address waveform applied to an address electrode in an address period and a driving method thereof.

According to an aspect of the present invention, there is provided a plasma display apparatus comprising: a plasma display panel in which a plurality of scan electrodes and a plurality of address electrodes intersecting the scan electrodes are formed; and a data driver for setting the address electrodes to be divided into a plurality of electrode groups and for applying an address waveform corresponding to a scan waveform applied to the scan electrode and having a time point different from an applying time point of the scan waveform to at least one address electrode group.

According to another aspect of the present invention, there is provided a plasma display apparatus comprising: a plasma display panel in which a plurality of scan electrodes and a plurality of address electrodes intersecting the scan electrodes are formed; and a data driver for applying an address waveform to the address electrode, wherein a scan waveform is applied to any one scan electrode and applying time points between the address waveforms applied to the address electrode corresponding to the scan waveform are different from each other.

According to still another aspect of the present invention, there is provided a plasma display apparatus comprising: a plasma display panel in which a plurality of scan electrodes and a plurality of address electrodes intersecting the scan electrodes are formed; and a data driver for setting the address electrodes to be divided into a plurality of electrode groups and for applying an address waveform corresponding to a scan waveform applied to the scan electrode and having a time point different from an applying time point of the scan waveform depending on panel capacitance to at least one address electrode group.

According to a further aspect of the present invention, there is provided a driving method of a plasma display apparatus which embodies an image by applying a predetermined waveform to a plurality of scan electrodes and a plurality of address electrodes intersecting the scan electrodes, the method comprising: dividing the address electrode into a plurality of electrodes; and applying an address waveform corresponding to a scan waveform applied on the scan electrode and having a applying time point different from an applying time point of the scan waveform depending on panel capacitance to at least one address electrode group.

According to a plasma display apparatus of the present invention and a driving method thereof, a noise of a waveform applied to the scan electrode or the sustain electrode is reduced by adjusting an applying time point of an address waveform applied to an address electrode in an address period, so that it is possible to secure driving stability of the plasma display apparatus.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
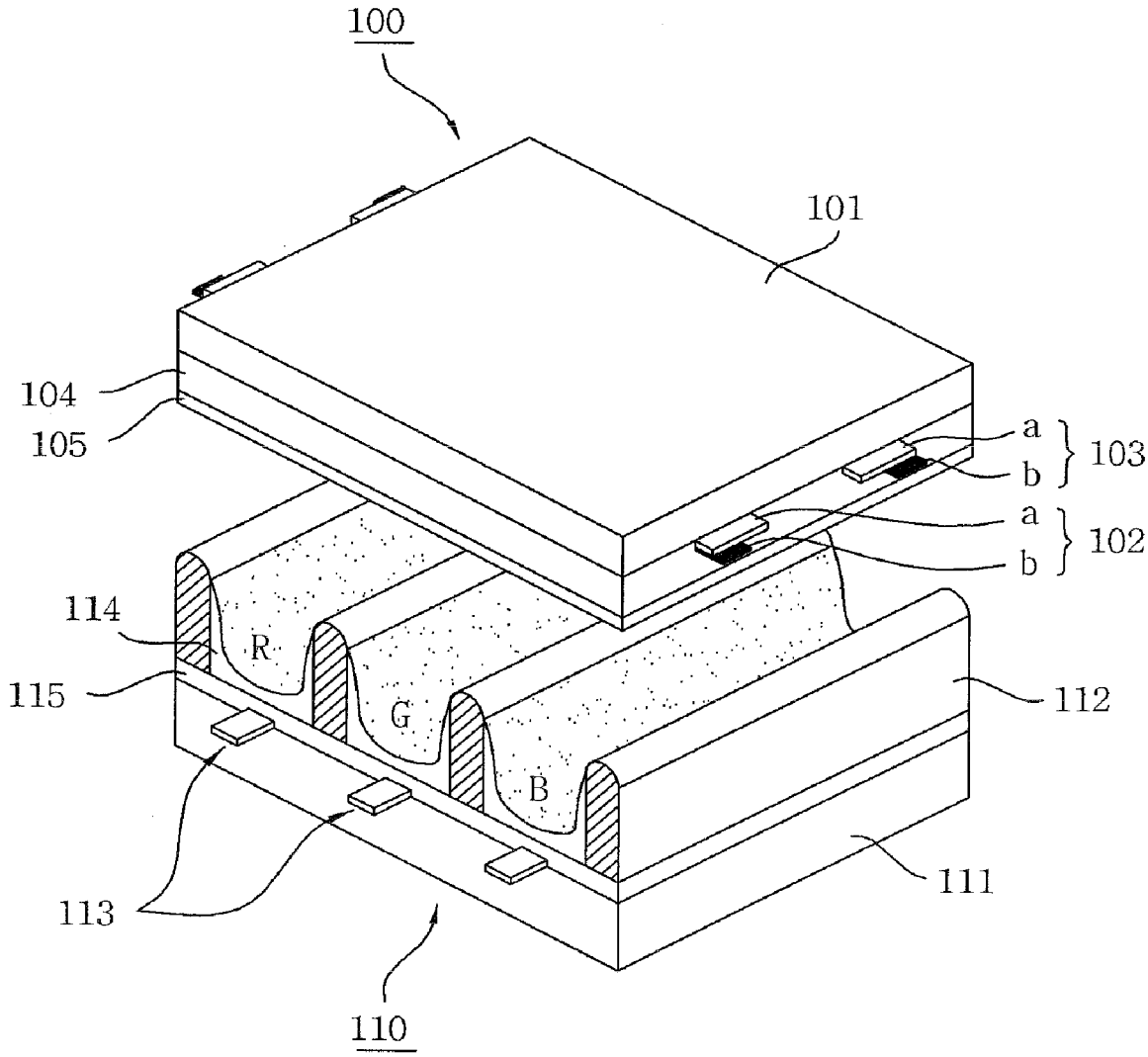
Fig. 1 PRIOR ART
FIG. 1 illustrates a structure of a general plasma display panel.
Figure 2:
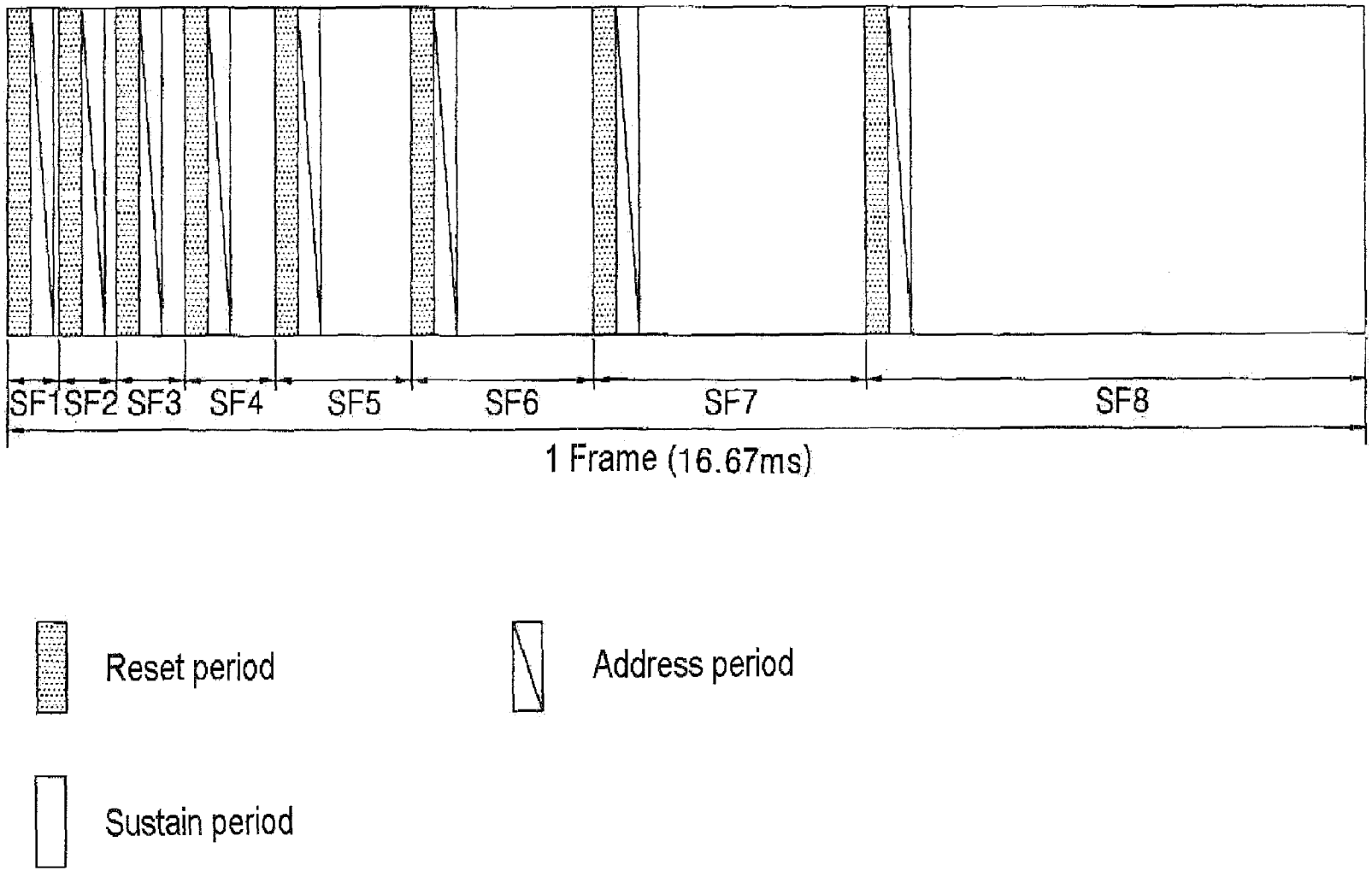
Fig. 2 PRIOR ART
FIG. 2 illustrates a method of embodying an image gray level of a conventional plasma display apparatus.

Preferred embodiments of the present invention will be described in a more detailed manner with reference to the drawings.

According to an aspect of the present invention, there is provided a plasma display apparatus comprising: a plasma display panel in which a plurality of scan electrodes and a plurality of address electrodes intersecting the scan electrodes are formed; and a data driver for setting the address electrodes to be divided into a plurality of electrode groups and for applying an address waveform corresponding to a scan waveform applied to the scan electrode and having an applying time point different from an applying time point of the scan waveform to at least one address electrode group.

The applying time point of the address waveform applied to at least one address electrode group may be earlier than the applying time point of the scan waveform.

The applying time point of the address waveform applied to at least one address electrode group may be later than the applying time point of the scan waveform.

A difference between applying time points of the address waveforms corresponding to one scan waveform may be from 10 ns to 1000 ns.

A difference between applying time points of the address waveforms corresponding to one scan waveform may be from one hundredth to one times greater than a width of the scan waveform.

A difference between an applying time point of the scan waveform and an applying time point of an address waveform which is most proximate to an applying time point of the scan waveform may be from 10 ns to 1000 ns.

A difference between an applying time point of the scan waveform and an applying time point of an address waveform which is most proximate to an applying time point of the scan waveform may be from one hundredth to one times greater than a predetermined width of the scan waveform.

The address electrode group may comprise at least one address electrode.

All of the address electrode groups may comprise the same number of the address electrode or at least one address electrode group may comprise the different number of address electrode.

The data driver may apply the address waveform to all address electrodes comprised in the one address electrode group at the same time point.

The number of the address electrode group may be at least two and be the total number or less of the address electrode.

According to another aspect of the present invention, there is provided a plasma display apparatus comprising: a plasma display panel in which a plurality of scan electrodes and a plurality of address electrodes intersecting the scan electrodes are formed; and a data driver for applying an address waveform to the address electrode, wherein a scan waveform is applied to any one scan electrode and an applying time points between the address waveforms applied to the address electrode corresponding to the scan waveform are different from each other.

A difference between applying time points of the address waveforms corresponding to one scan waveform may be from 10 ns to 1000 ns.

A difference between applying time points of the address waveforms corresponding to one scan waveform may be from one hundredth to one times greater than a width of the scan waveform.

The address electrode may be divided into a plurality of electrodes and applying time points between address waveforms applied to the address electrode group corresponding to the scan waveform may be different from each other in at least one subfield of a frame.

According to still another aspect of the present invention, there is provided a plasma display apparatus comprising: a plasma display panel in which a plurality of scan electrodes and a plurality of address electrodes intersecting the scan electrodes are formed; and a data driver for setting the address electrodes to be divided into a plurality of electrode groups and for applying an address waveform corresponding to the scan waveform applied to the scan electrode and having an applying time point different from an applying time point of a scan waveform depending on a panel capacitance to at least one address electrode group.

The panel capacitance may increase as the number of address electrode to which the address waveform is applied increases corresponding to the one scan waveform.

As the panel capacitance increases, the number of address waveform earlier than or later than an applying time point of the scan waveform may increase.

As the number of address electrode to which the address waveform is applied decreases corresponding to the one scan waveform, the panel capacitance may decrease.

As the panel capacitance decreases, the number of address waveform earlier than or later than an applying time point of the scan waveform may decrease.

According to a further aspect of the present invention, there is provided a driving method of a plasma display apparatus which embodies an image by applying a predetermined waveform to a plurality of scan electrodes and a plurality of address electrodes intersecting the scan electrodes, the method comprising: dividing the address electrode into a plurality of electrodes; and applying an address waveform corresponding to a scan waveform applied on the scan electrode and having a time point different from an applying time point of the scan waveform depending on a panel capacitance to at least one address electrode group.

First Embodiment

Figure 4:
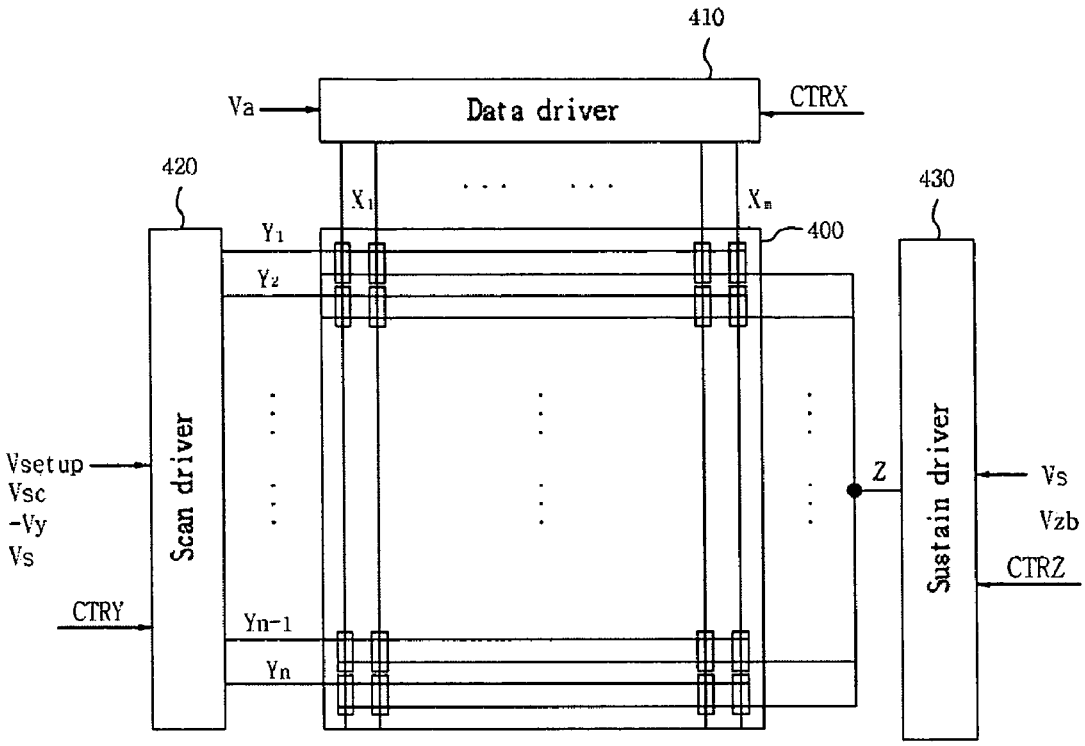
FIG. 4 illustrates a plasma display apparatus according to a first embodiment of the present invention.

FIG. 4 illustrates a plasma display apparatus according to a first embodiment of the present invention.

As shown in FIG. 4, the plasma display apparatus according to the present invention comprises a plasma display panel 400, a data driver 410, a scan driver 420, and a sustain driver 430.

In the plasma display panel 400, a front substrate (not shown) and a rear substrate (not shown) are coupled to each other. Scan electrodes (Y1 to Yn) and a sustain electrode (Z) are formed in the front substrate and a plurality of address electrodes (X1 to Xm) intersecting the scan electrodes (Y1 to Yn) and the sustain electrode (Z) are formed in the rear substrate.

The data driver 410 applies data to the address electrodes (X1 to Xm) formed in the plasma display panel 400. The data are image signal data processed in an image signal processor (not shown) that processes an image signal inputted from the outside. The data driver 410 samples and latches data in response to a data timing control signal (CTRX) from a timing controller (not shown) and then applies an address waveform having an address voltage (Va) to each of address electrodes (X1 to Xm). In the first embodiment of the present invention, a plurality of address electrodes (X1 to Xm) is divided into a plurality of electrode groups and an address waveform corresponding to a scan waveform applied to the scan electrode is applied to at least one address electrode group at a time point different from an applying time point of the scan waveform.

The scan driver 420 drives the scan electrodes (Y1 to Yn) formed in the plasma display panel 400. The scan driver 420 applies a setup waveform to be a ramp-up waveform by combining a sustain voltage (Vs) and a setup voltage (Vsetup) to the scan electrodes (Y1 to Yn) during a setup period of a reset period in response to a scan timing control signal (CTRY) from the timing controller (not shown). Thereafter, the scan driver 420 applies a setdown waveform to be a ramp-down waveform after the setup waveform to the scan electrodes (Y1 to Yn) during a setdown period of a reset period. Thereafter, the scan driver 520 sequentially applies a scan waveform applied from a scan reference voltage (Vsc) to a scan voltage (−Vy) to each of scan electrodes (Y1 to Yn) during an address period. Thereafter, the scan driver 420 applies at least one sustain waveform to perform display discharge applied from a around level (GND) to a sustain voltage (Vs) to the scan electrodes (Y1 to Yn) during a sustain period.

The sustain driver 430 drives the sustain electrode (Z) that is a common electrode in the plasma display panel 400. The sustain driver 430 applies a waveform having a bias voltage (Vzb) of a positive polarity to the sustain electrode (Z) during an address period in response to a scan timing control signal (CTRZ) from the timing controller (not shown). Thereafter, the sustain driver 530 applies at least one sustain waveform to perform display discharge which is applied from a ground level (GND) to a sustain voltage (Vs) to the sustain electrode (Z) during a sustain period.

Figure 5:
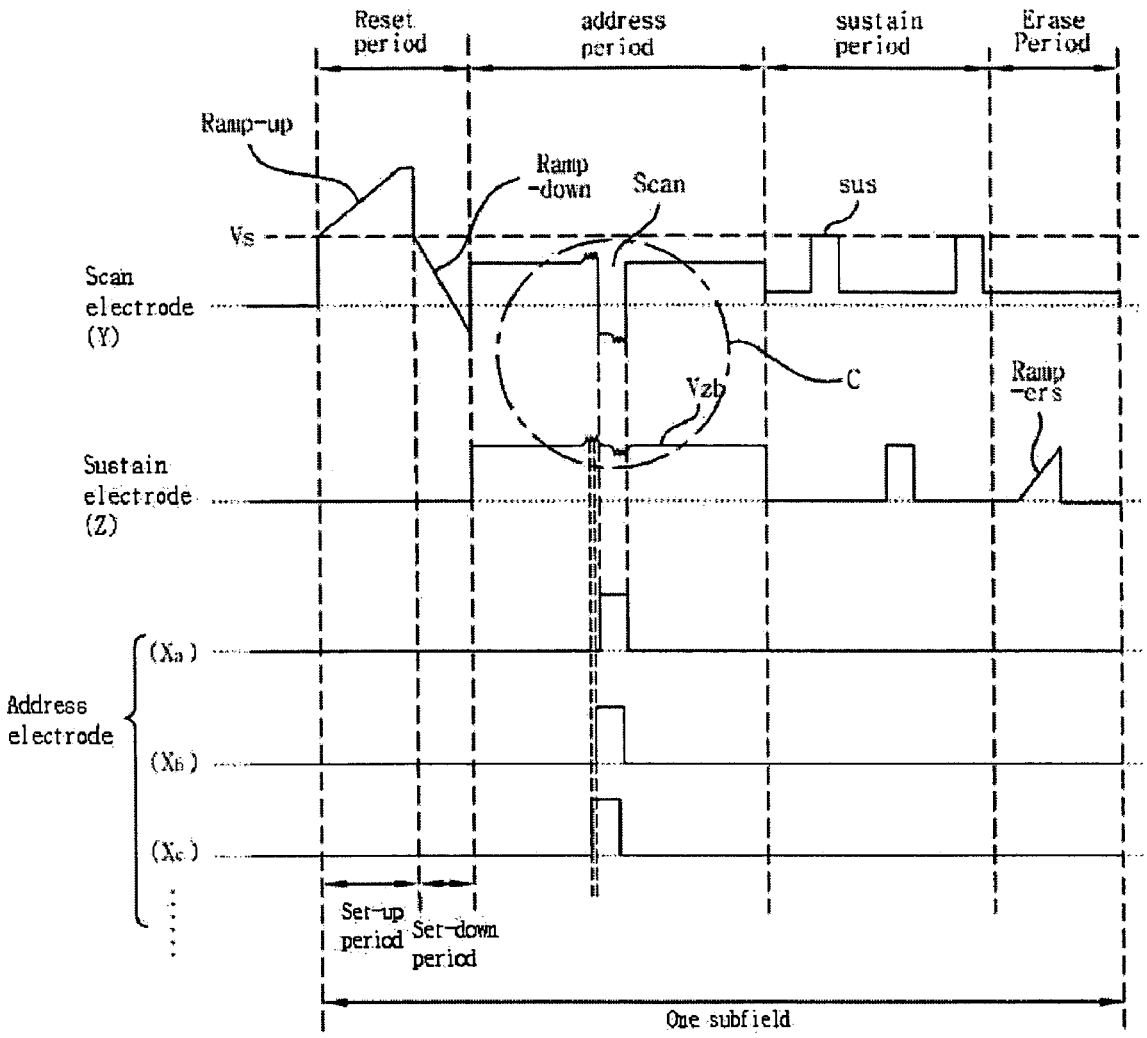
FIG. 5 illustrates a driving waveform according to the first embodiment of the present invention.

FIG. 5 illustrates a driving waveform according to the first embodiment of the present invention.

As shown in FIG. 5, the plasma display apparatus according to the first embodiment of the present invention are divided into a reset period for initializing all cells, an address period for selecting a cell to be discharged, a sustain period for sustaining discharge of the selected cell, and an erasing period for erasing wall charges within the discharged cell and driven. A driving method according to embodiments of the present invention is not always divided into a reset period, an address period, a sustain period, and an erasing period. That is, all or a portion of the reset period and/or an erasing period may be omitted in at least one subfield among a plurality of subfields.

In the setup period of the reset period, a setup waveforms to be ramp-up waveforms are simultaneously applied to all scan electrodes (Y). Due to the setup waveform, weak dark discharge occurs within the discharge cells of an entire screen. Due to the setup discharge, wall charges having a positive polarity are accumulated on the address electrode and the sustain electrode and wall charges having a negative polarity are accumulated on the scan electrode (Y).

In the setdown period, a setdown waveform falling from a ground level (GND) to a predetermined voltage (−Vy) level is applied to all scan electrodes. Therefore, erasing discharge occurs between the scan electrode and the address electrode within cells, thereby fully erasing wall charges generated between the scan electrode and the address electrode. Due to the setdown waveform, wall charges to stably generate address discharge within the cells to display an image in a sustain period uniformly remain within the cells.

In the address period, scan waveforms having a negative polarity are sequentially applied to the scan electrodes and are synchronized with the scan waveforms, and thus address waveforms having a positive polarity are applied to the address electrode. As a potential difference between the scan waveform and the address waveform is added to a wall voltage generated in the reset period, the address discharge occurs within the discharge cell to which the address waveform is applied. The wall charges are formed within the cells selected by the address discharge, so that discharge occurs when a sustain waveform of a sustain voltage (Vs) level is applied. A waveform having a bias voltage (Vz) having a positive polarity is supplied to the sustain electrode so that erroneous discharge with the scan electrode does not occur by reducing a potential difference with the scan electrode during the address period. In the first embodiment of the present invention, address electrodes are divided into a plurality of address electrode groups and address waveforms corresponding to the scan waveform and having a different applying time point are applied to at least one address electrode group.

In the sustain period, the sustain waveform (Sus) to be a waveform having a positive polarity is alternately applied to the scan electrode and the sustain electrode. As the wall voltage within the cell is added to a voltage of the sustain waveform in the cell selected by the address discharge, the sustain discharge, that is, the display discharge occurs between the scan electrode and the sustain electrode whenever each sustain waveform is applied.

After the sustain discharge is completed, an erasing ramp-ers having a narrow waveform width and a low voltage level is supplied to the sustain electrode (Z) in an erasing period, thereby erasing the wall charges remaining within the cells of an entire screen.

Figure 6A:
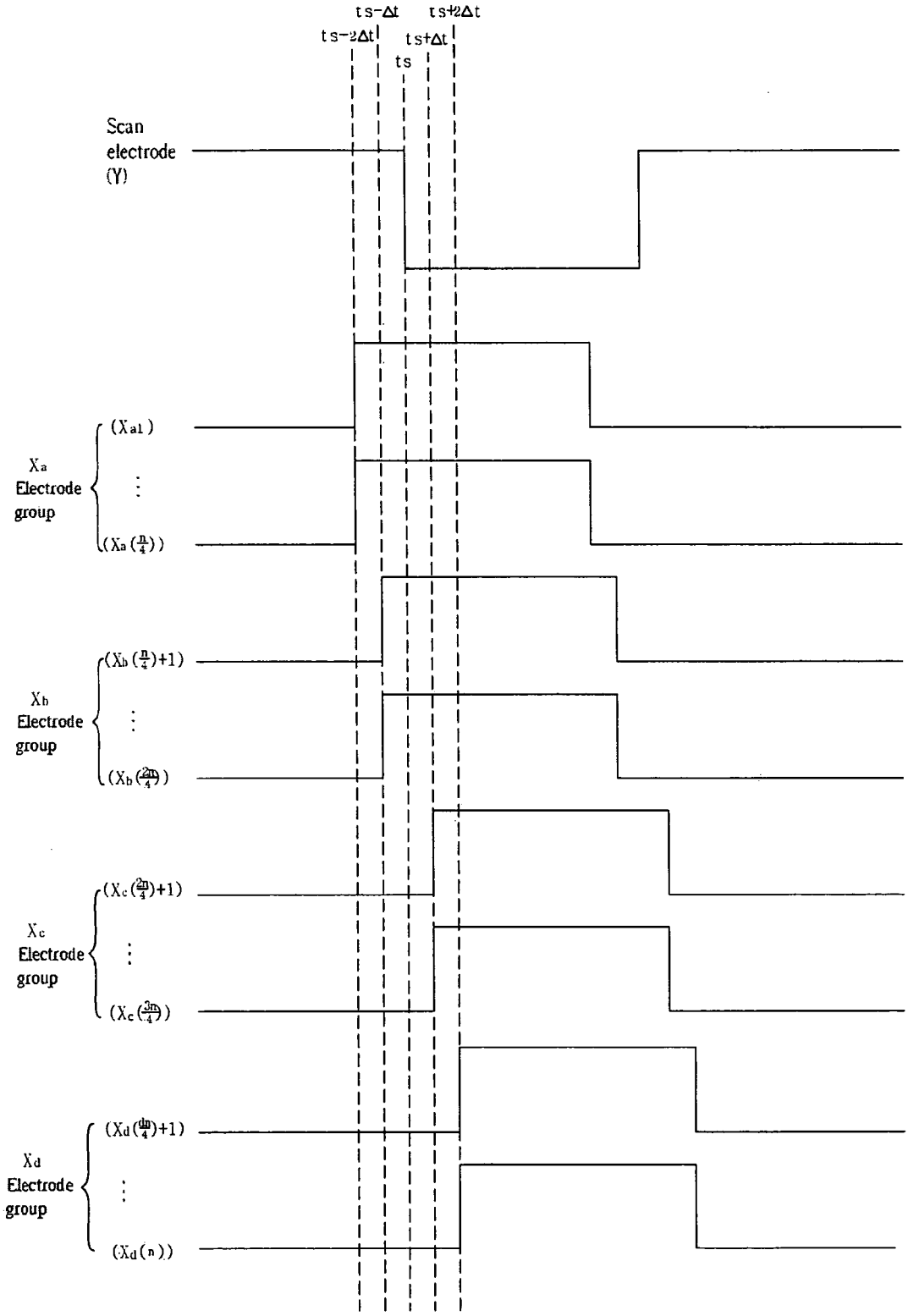
FIGS. 6A to 6C illustrate a driving waveform of an address period according to the first embodiment of the present invention.
Figure 6B:
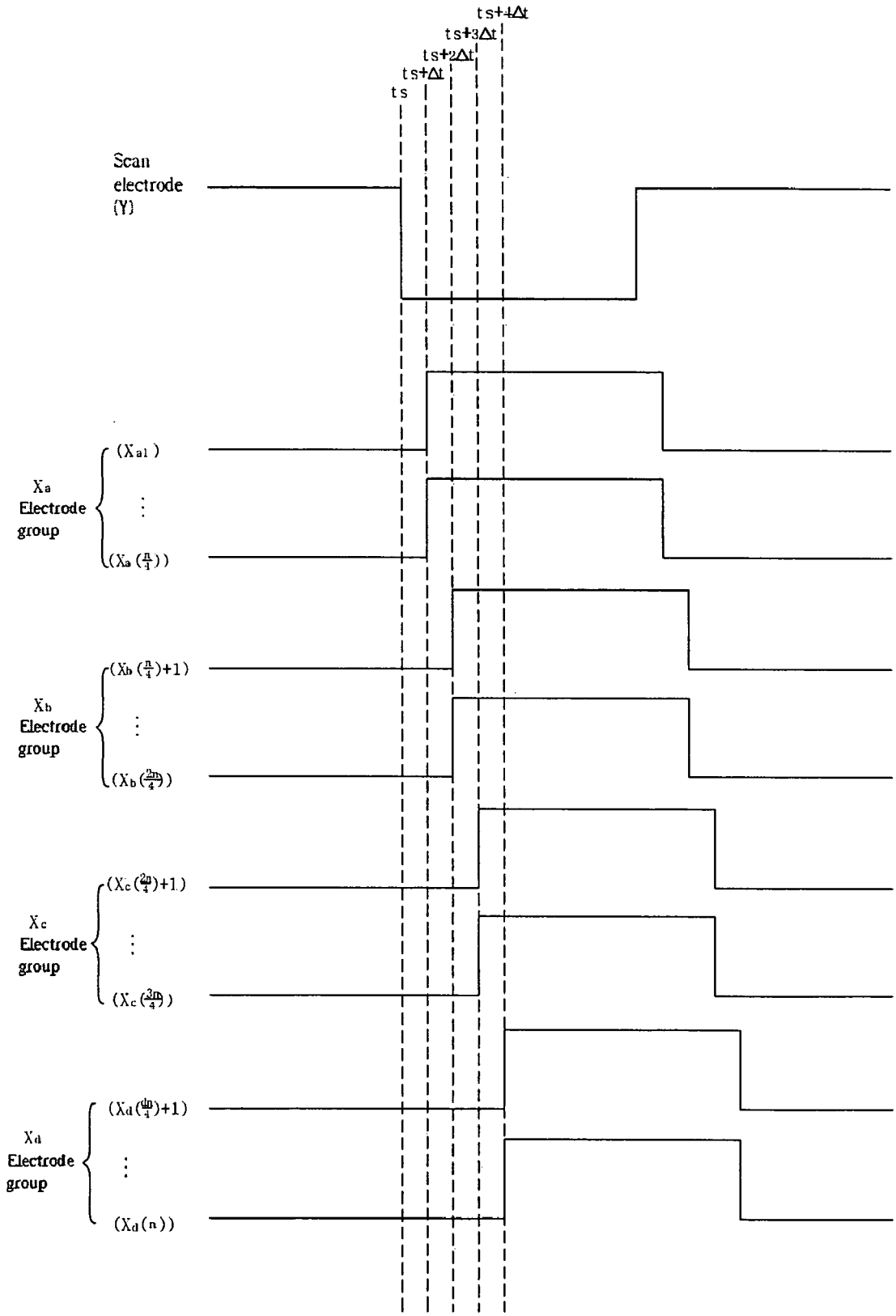
Figure 6C:
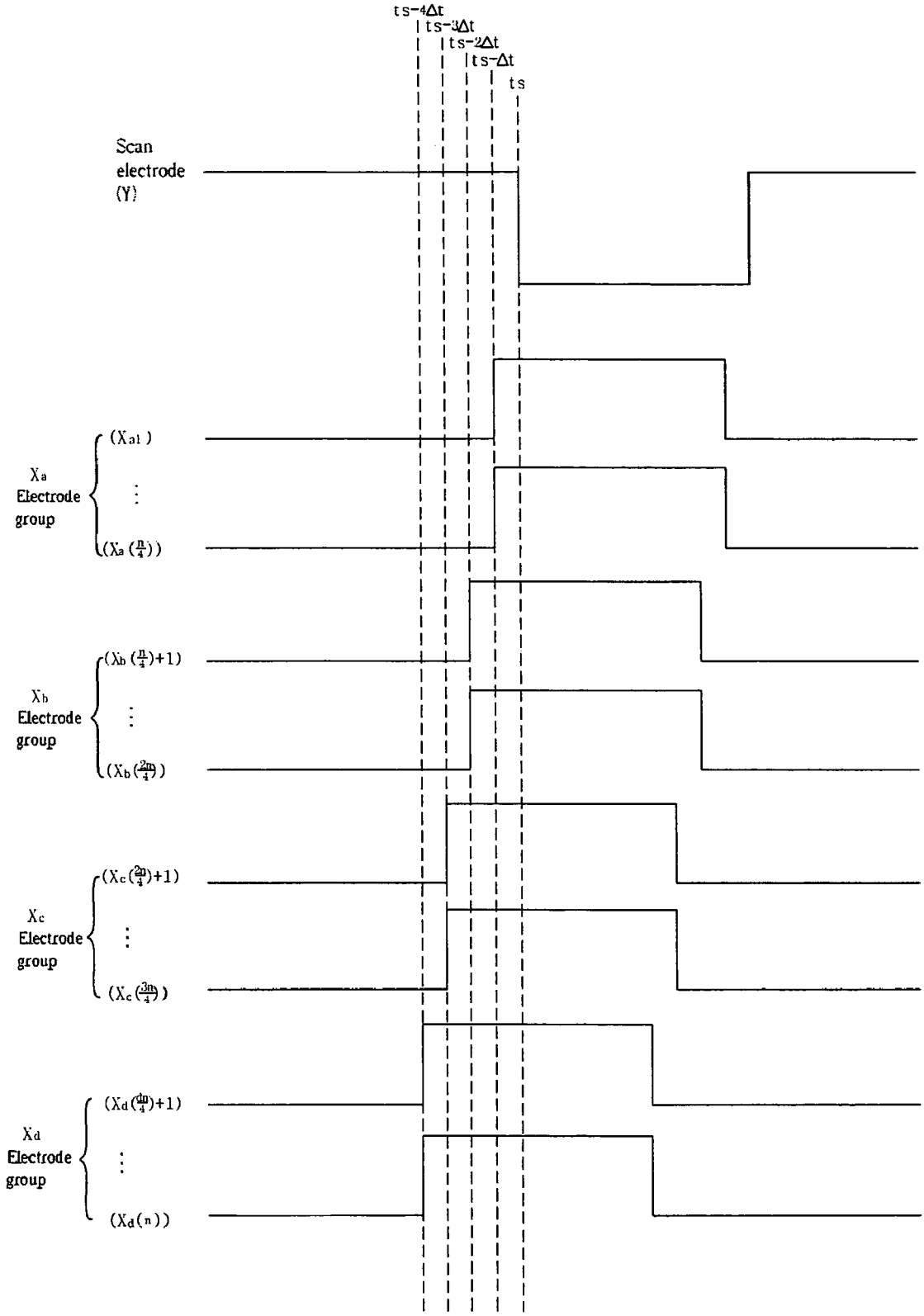

FIGS. 6A to 6C illustrate a driving waveform of an address period according to the first embodiment of the present invention.

As shown in FIGS. 6A to 6C, the driving waveform of an address period according to the first embodiment of the present invention divides a plurality of address electrodes (X1 to Xn) into a plurality of address electrode groups (Xa electrode group, Xb electrode group, Xc electrode group, and Xd electrode group) and applies an address waveform corresponding to a scan waveform applied to a scan electrode (Y) to at least one address electrode at a time point different from an applying time point of the scan waveform.

As shown in FIG. 6A, if it is assumed that an applying time point of the scan waveform applied to the scan electrode (Y) is "ts", an address waveform is applied to address electrodes (Xa1 to Xa (n/4)) comprised in the Xa electrode group at a time point earlier by "2Δt" than a time point in which the scan waveform is applied, that is, at a time point of "ts−2Δt" to the scan electrode (Y) depending on an arrangement order of address electrodes group comprising address electrodes (X1 to Xn). In addition, an address waveform is applied at a time earlier by "Δt" than a time point in which the scan waveform is applied to the scan electrode (Y), that is, at a time point of "ts−Δt" to address electrodes (Xb(n/4)+1 to Xb(2n/4)) comprised in Xb electrode group. In this way, an address waveform is applied to address electrodes (Xc(2n/4)+1 to Xc(3n/4)) comprised in Xc electrode group at a time point of "ts+Δt" and an address waveform is applied to address electrodes (Xd(3n/4)+1 to Xd(n)) comprised in Xd electrode group at a time point of "ts+2Δt". That is, as in FIG. 6A, an address waveform applied to each of Xa, Xb, Xc, and Xd electrode groups comprising address electrodes (X1 to Xn) is applied before or after an applying time point of the scan waveform applied to the scan electrode (Y).

As shown in FIG. 6B, a driving waveform of an address period according to the first embodiment of the present invention is applied so that an applying time point of an address waveform applied to a plurality of address electrode groups (Xa, Xb, Xc, Xd) comprising address electrodes (X1 to Xn) is later than an applying time point of a scan waveform applied to the scan electrode (Y).

As shown in FIG. 6C, a driving waveform of the address period according to the first embodiment of the present invention is applied so that an applying time point of an address waveform applied to a plurality of address electrode groups (Xa, Xb, Xc, Xd) comprising address electrodes (X1 to Xn) is earlier than an applying time point of a scan waveform applied to the scan electrode (Y).

The number of address electrodes comprised in each of address electrode groups (Xa, Xb, Xc, Xd) is set to be equal in FIGS. 6A to 6C, but the number of address electrodes comprised in each of address electrode groups (Xa, Xb, Xc, Xd) can be set to be different from each other. That is, the address electrode group according to the first embodiment of the present invention comprises at least one address electrode.

In addition, it is possible to adjust the number of address electrode groups. The number of address electrode groups can be set from at least two to the number smaller than the total number of the address electrodes, that is, to the number of $2 \leqq N \leqq (n-1)$. At this time, the data driver allows an address waveform to apply to all address electrodes comprised in one address electrode group at the same time point.

Further, in FIGS. 6A to 6C, it is assumed that an applying time point of a scan waveform applied to the scan electrode (Y) is "ts", a time difference between an applying time point "ts" of the scan waveform and an applying time point of an address waveform which is most proximate to the applying time point "ts" of the scan waveform is "Δt", and a time difference between an applying time point "ts" of the scan waveform and an applying time point of an address waveform which is next proximate to the applying time point "ts" of the scan waveform is "2Δt". The "Δt" is uniformly sustained. That is, in the first embodiment of the present invention, a difference between applying time points of a plurality of address electrode groups can be equal to each other while an applying time point of an address waveform applied to at least one address electrode group among a plurality of address electrode groups can be different from that of the scan waveform applied to the scan electrode (Y).

Otherwise, in at least one electrode group among a plurality of address electrode groups, applying time points between a plurality of address electrode groups may be set to be different from each other while an applying time point of an address waveform applied to an address electrode is set to be different from an applying time point of a scan waveform applied to the scan electrode (Y). That is, if it is assumed that a time difference between an applying time point "ts" of a scan waveform and an applying time point of an address waveform which is most proximate to an applying time point "ts" of the scan waveform is "Δt", a time difference between an applying time point of a scan waveform "ts" and an applying time point of the address waveform which is next proximate to an applying time point "ts" of the scan waveform may be "3Δt"

Considering a limited address period, it is preferable that a difference between applying time points of address waveforms corresponding to one scan waveform is set to be from 10 ns to 1000 ns. In addition, considering any one scan waveform width according to driving of a plasma display apparatus, it is preferable that a difference between applying time points of address waveforms corresponding to one scan waveform is set to be from one-hundredth to one times greater than a predetermined scan waveform width.

In addition, if it is assumed that an applying time point of a scan waveform applied to the scan electrode (Y) is "ts", a difference between an applying time point "ts" of the scan waveform and an applying time point of an address waveform which is most proximate to the applying time point "ts" may be equal to or different from each other within one subfield, regardless of an applying time point of address waveform of a plurality of address electrode groups. Considering the limited address period, it is preferable that a difference between an applying time point of the scan waveform and an applying time point of the address waveform which is most proximate to an applying time point of the scan waveform is set to be from 10 ns to 100 ns. In addition, considering any one scan waveform width according to driving of a plasma display panel, it is preferable that a difference between an applying time point of the scan waveform and an applying time point of the address waveform which is most proximate to an applying time point of the scan waveform is set to be from one-hundredth to one times greater than the scan waveform width.

On the other hand, in FIGS. 6A to 6C, an applying time point of an address waveform applied to all address electrode groups is different from that of an scan waveform, but an applying time point of a waveform applied to at least one address electrode group may be different from an applying time point of the scan waveform. That is, an applying time point of an address waveform and an applying time point of a scan waveform may be equal in at least one address electrode. In addition, an address waveform may be applied to a plurality of address electrode groups at the same time point. That is, an applying time point of address waveform can be different from that of an address waveform in other address electrode groups in only at least one among a plurality of address electrode groups.

Figure 7:
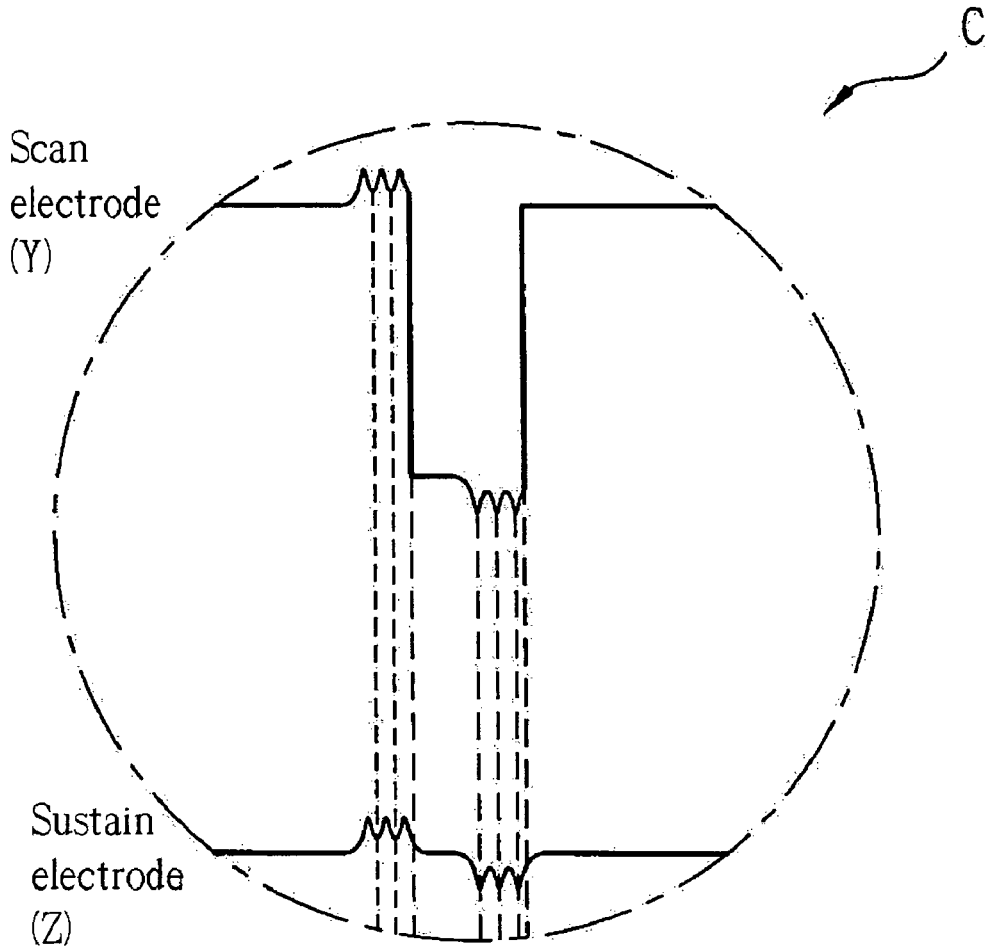
FIG. 7 illustrates C area of FIG. 5.

FIG. 7 illustrates C area of FIG. 5.

Figure 3:
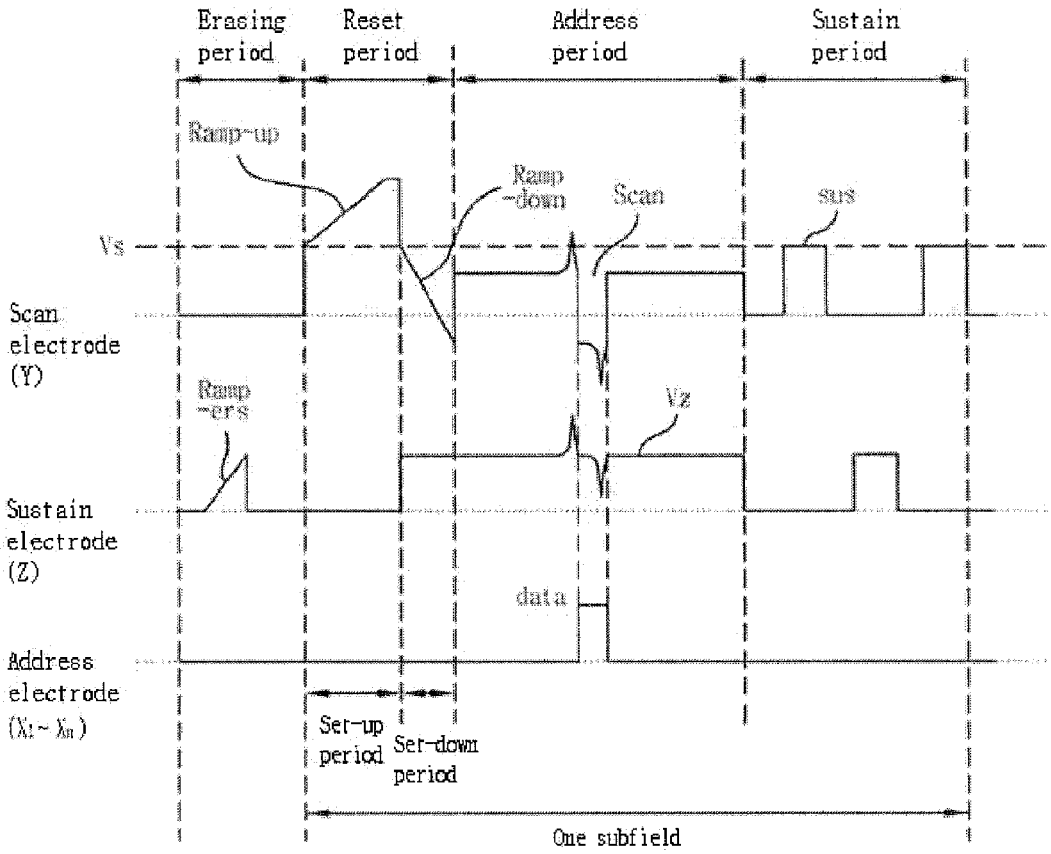
Fig. 3 PRIOR ART
FIG. 3 illustrates a driving waveform of the conventional plasma display apparatus.

FIG. 7 is a magnified diagram of C area of FIG. 5 and shows that a sufficient amount of a noise is reduced in a waveform applied to a scan electrode and a sustain electrode, compared to that of FIG. 3. In this way, when an applying time point of a scan waveform applied to the scan electrode (Y) in an address period and an applying time point of an address waveform applied to each of address electrode groups (Xa, Xb, Xc, Xd) are different from each other, a noise can be reduced at each applying time point. Therefore, address discharge occurring in the address period becomes stable and thus it is possible to prevent deterioration of driving stability of the plasma display apparatus. In addition, by stabilizing address discharge, a single scan method of scanning an entire panel with one driver can be applied. A single scan method is a driving method in which an applying time point of a scan waveform applied to many scan electrodes formed in a display area of a front substrate is differently driven in each of many scan electrodes.

Figure 8:
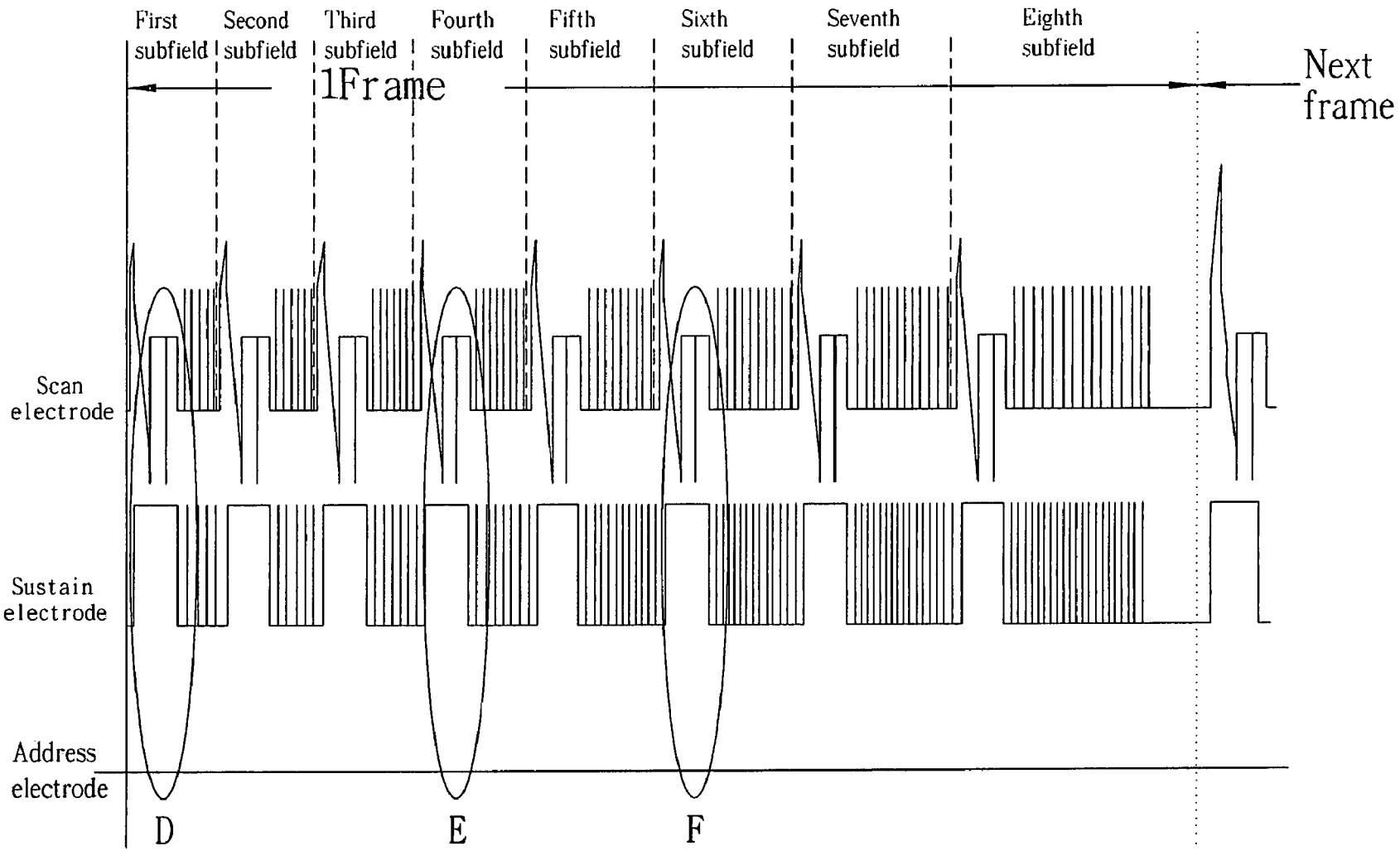
FIG. 8 illustrates another driving waveform of the address period according to the first embodiment of the present invention.

FIG. 8 illustrates another driving waveform of the address period according to the first embodiment of the present invention.

As shown in FIG. 8, in an example of a method of allowing an applying time point of an address waveform and that of an scan waveform to be different from each other, a time difference between applying time points of address waveforms applied to the address electrode group is set to be "Δt" while an applying time point of an address waveform applied to an address electrode group in a first subfield of one frame is set to be different from that of a scan waveform applied to the scan electrode (Y). In addition, in a second subfield, as in the first subfield, a time difference between applying time points of address waveforms applied to the address electrode group is set to be "2Δt" while an applying time point of an address waveform applied to an address electrode group is set to be different from that of a scan waveform applied to the scan electrode (Y). In this way, a time difference between applying time points of address waveforms applied to the address electrode group is set to be different from each other, for example, "3Δt" and "4Δt" for each subfield comprised in one frame.

Otherwise, in a driving waveform of the present invention, an applying time point of an address waveform may be set to be different from, that is, before or after that of an scan waveform for each subfield while an applying time point of an address waveform and that of a scan waveform are different from each other in at least one subfield. For example, in the first subfield, an applying time point of an address waveform may be set to be before or after that of a scan waveform, in the second subfield, all of the applying time points of an address waveform may be set to be earlier than an applying time point of the scan waveform, and in the third subfield, all of the applying time points of the address waveform may be set to be later than an applying time point of the scan waveform. D, E, and F areas of FIG. 8 will be described with reference to FIGS. 9*a* to 9*c*.

Figure 9A:
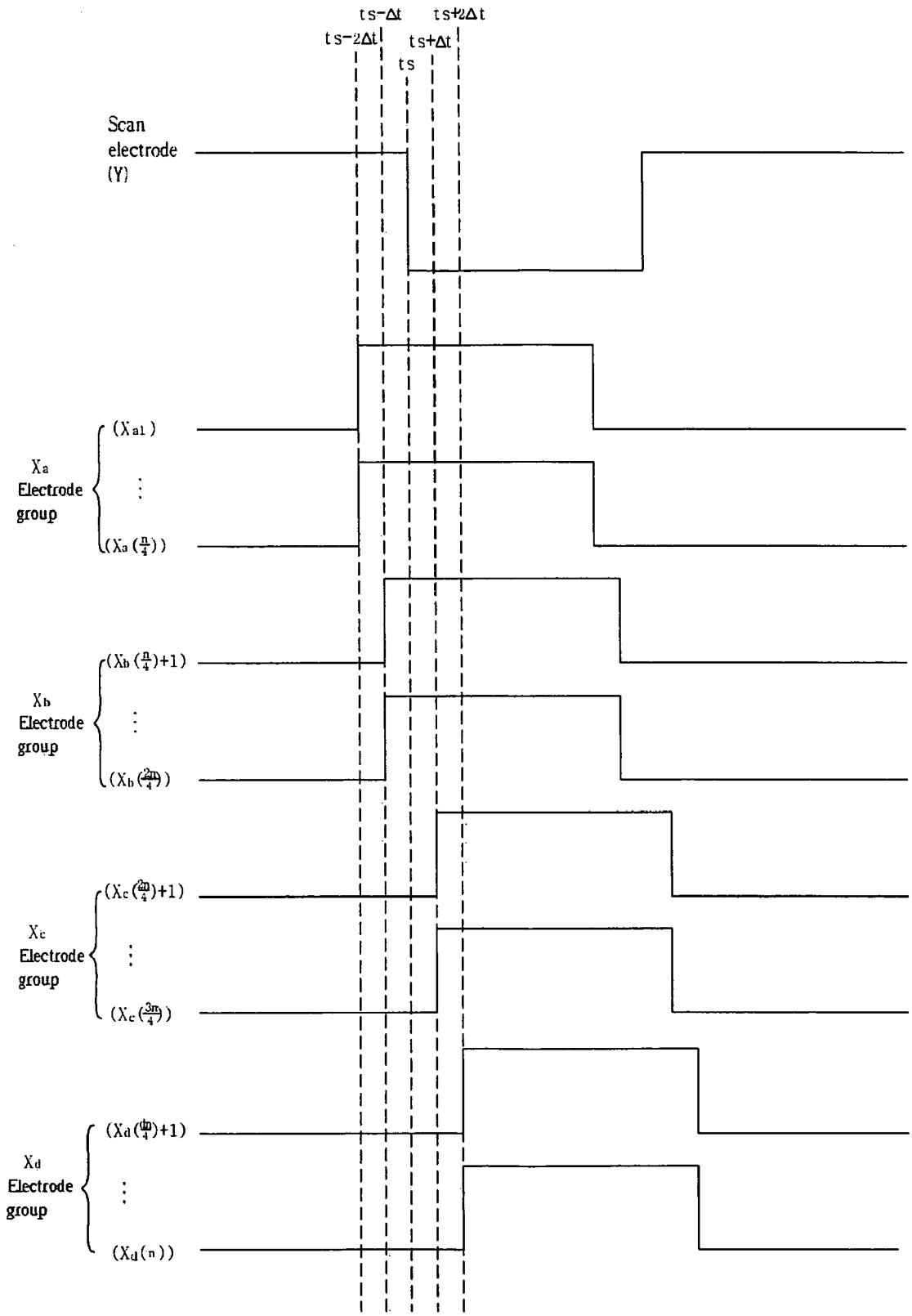
FIGS. 9*a* to 9C illustrate in detail the driving waveform of FIG. 8.
Figure 9B:
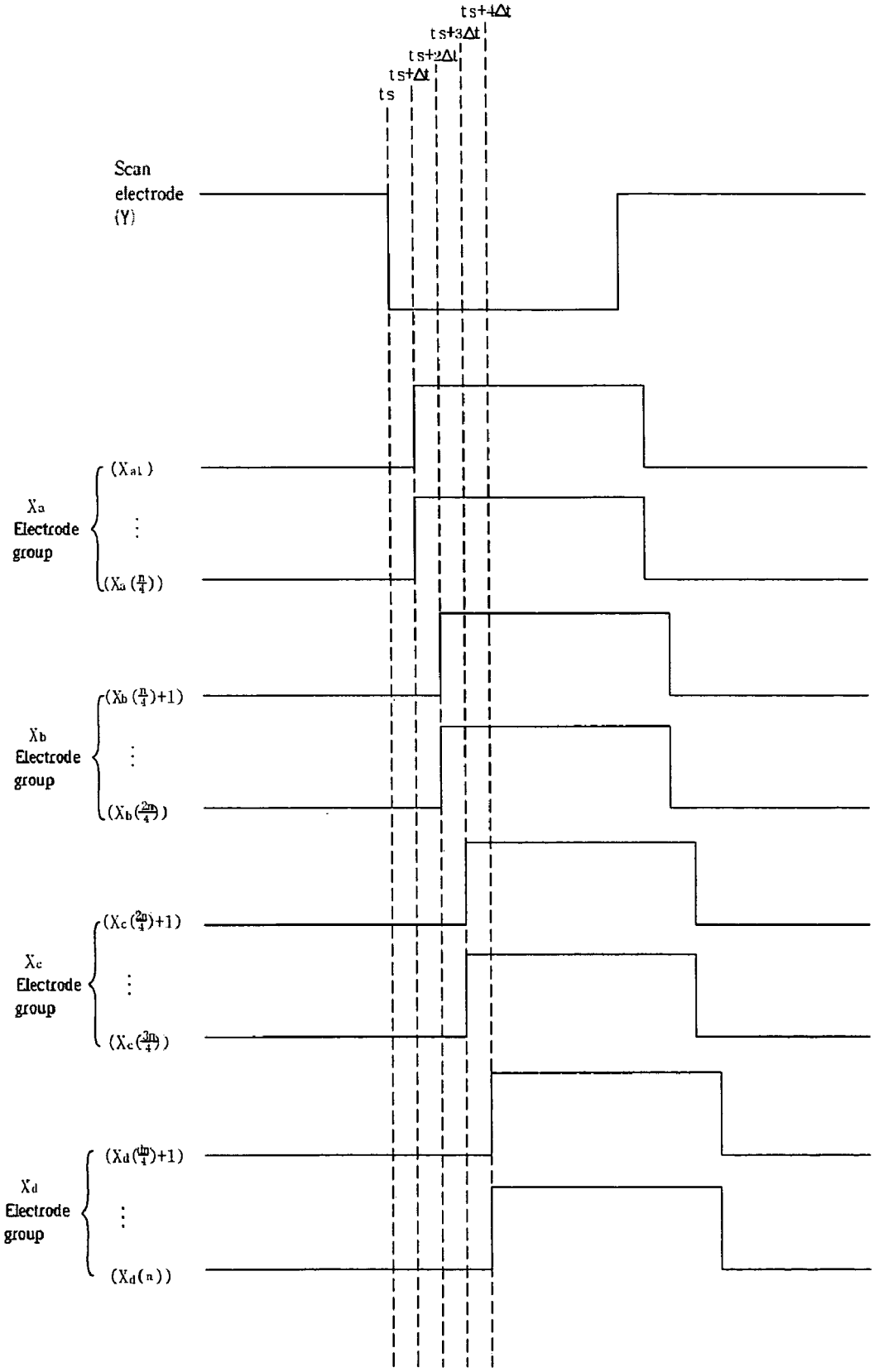
Figure 9C:
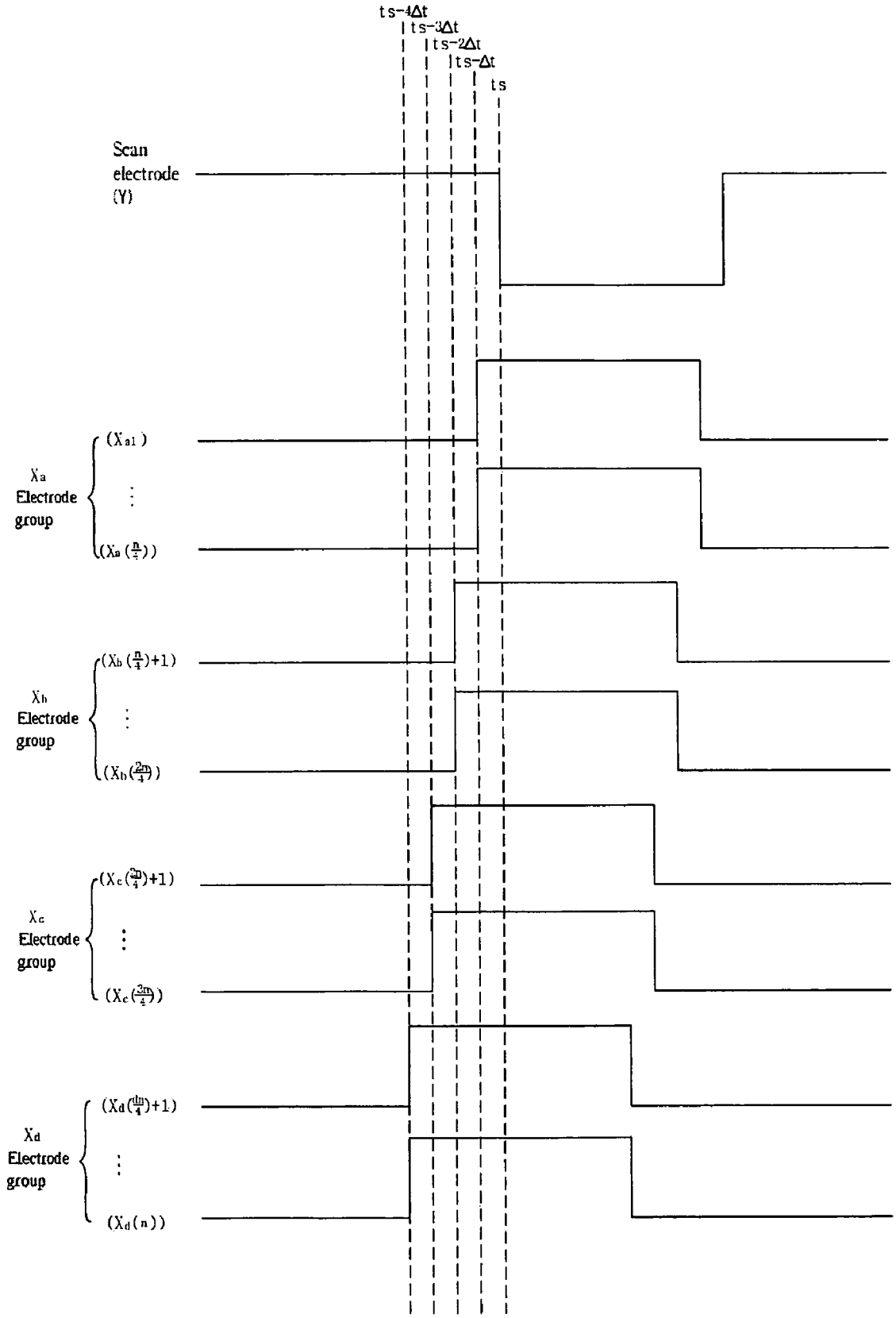

FIGS. 9A to 9C illustrate in detail the driving waveform of FIG. 8.

First, referring to FIG. 9A, if it is assumed that an applying time point of a scan waveform applied to the scan electrode (Y) in the first subfield is "ts", in D area of FIG. 8, an address waveform is applied to address electrode group Xa at a time point earlier by "2Δt" than a time point in which an scan waveform applied to the scan electrode (Y), that is, at a time point of "ts−2Δt" depending on an arrangement order of address electrode groups (Xa, Xb, Xc, Xd). In addition, an address waveform is applied to address electrode group Xb at a time point earlier by "Δt" than a time point in which an scan waveform applied to the scan electrode (Y), that is, at a time point of "ts−Δt". In this way, an address waveform is applied to address electrode group Xc at a time point of "ts+Δt" and an address waveform is applied to address electrode group Xd at a time point of "ts+2Δt".

Referring to FIG. 9B, in E area of FIG. 8, an applying time point of an address waveform applied to address electrode groups (Xa, Xb, Xc, Xd) is different from an applying time point of an scan waveform applied to the scan electrode (Y) and an applying time point of all address waveforms is later than an applying time point of the scan waveform.

Referring to FIG. 9C, in F area of FIG. 8, an applying time point of an address waveform applied to address electrode groups (Xa, Xb, Xc, Xd) is different from that of an scan waveform applied to the scan electrode (Y) and an applying time point of all address waveforms is earlier than that of the scan waveform.

Second Embodiment

Like the plasma display apparatus according to the first embodiment of the present invention, a plasma display apparatus according to the second embodiment of the present invention comprises a plasma display panel, a data driver, a scan driver, and a sustain driver.

Unlike the plasma display apparatus according to the first embodiment of the present invention, the plasma display apparatus according to the second embodiment of the present invention applies a scan waveform to any one scan electrode and allows applying time points between address waveforms applied to the address electrode corresponding to the scan waveform to be different from each other. That is, applying time points of address waveforms applied to each address electrode are adjusted to be different from each other.

A method of applying at least two address waveforms having different applying time points corresponding to a scan waveform according to the second embodiment of the present invention can be variously changed. A method of applying an address waveform to each of a plurality of address electrode at a time point different from an applying time point of a scan waveform will be described with reference to FIGS. 10A to 10E.

FIGS. 10A to 10E illustrate a driving waveform of an address period according to a second embodiment of the present invention.

Figure 10A:
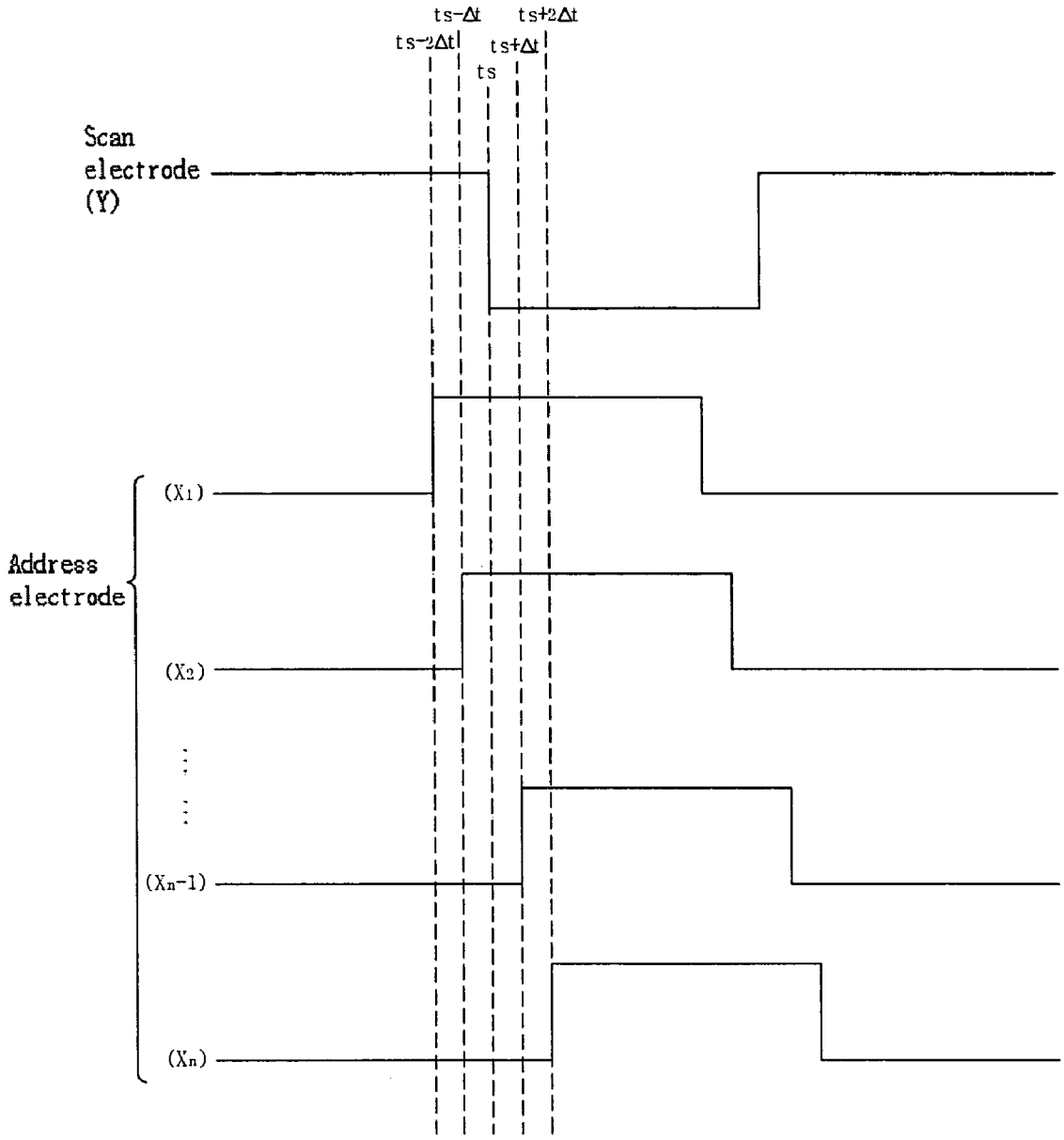
FIGS. 10A to 10E illustrate a driving waveform of an address period according to a second embodiment of the present invention.

As shown in FIG. 10A, a driving waveform in an address period according to the second embodiment of the present invention is applied so that at least two address waveforms are earlier than or later than corresponding to a scan waveform. For example, as in FIG. 10A, if it is assumed that an applying time point of a scan waveform applied to the scan electrode (Y) is "ts", an address waveforms is applied to an address electrode (X1) at a time point earlier by Δ2t than a time point in which a scan waveform is applied to the scan electrode (Y) to, that is, at a time point of "ts−2Δt" depending on an arrangement order of address electrodes (X1 to Xn). In addition, an address waveforms is applied to an address electrode X2 at a time point earlier by "Δt" than a time point in which a scan waveform is applied to the scan electrode (Y) to, that is, at a time point of "ts−Δt". In this way, an address waveform is applied to X(n−1) electrode at a time point of "ts+Δt", and an address waveform is applied to Xn electrode at a time point of "ts+2Δt". That is, as in FIG. 8A, an address waveform applied to address electrodes (X1 to Xn) is applied before or after an applying time point of the scan waveform applied to the scan electrode (Y).

Figure 10B:
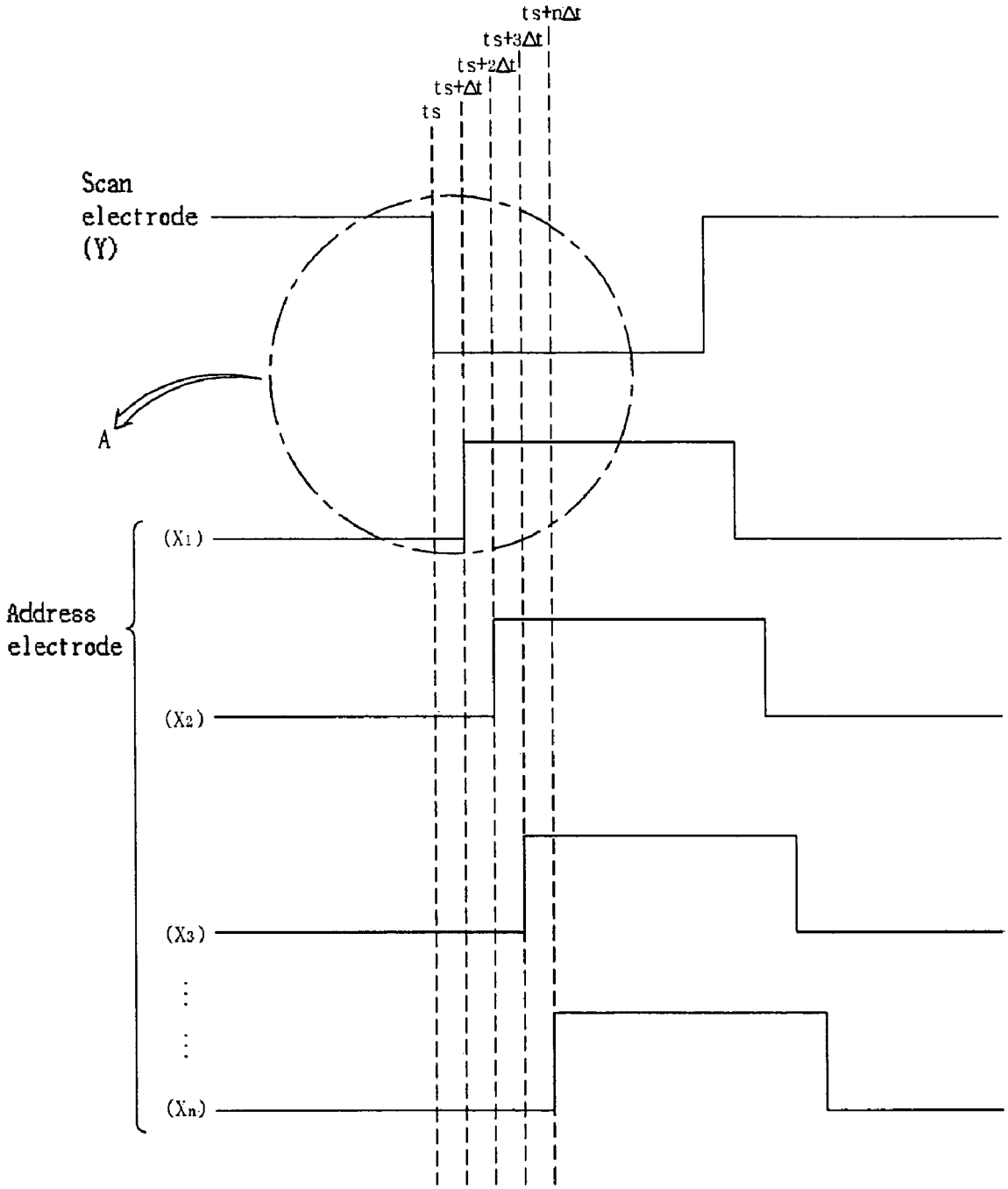

As shown in FIG. 10B, a driving waveform in an address period according to the second embodiment of the present invention is applied so that an applying time point of an address waveform applied to address electrodes (X1 to Xn) is later than an applying time point of the scan waveform applied to the scan electrode (Y).

Figure 10C:
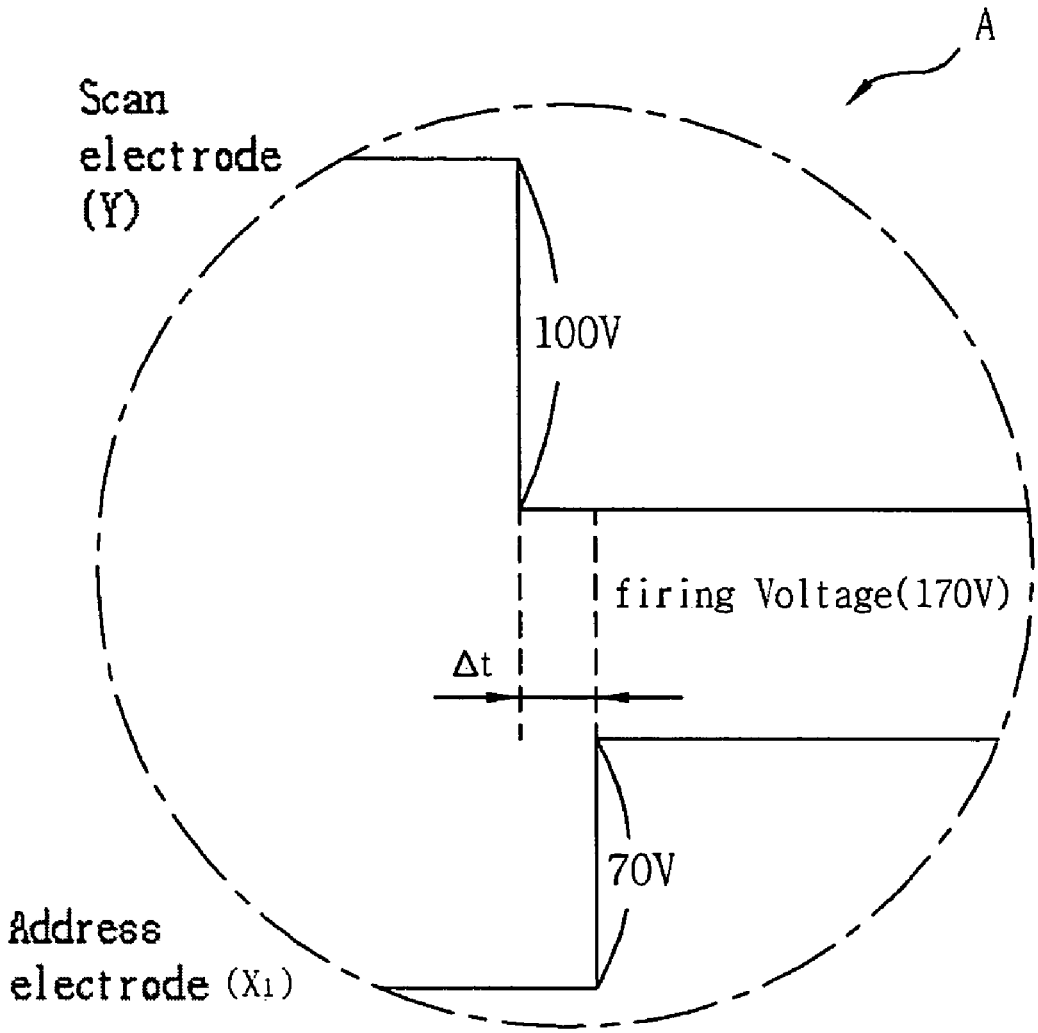

Area A of FIG. 10B will be described with reference to FIG. 10C. For example, if it is assumed that an address discharge firing voltage is 170V and a voltage of a scan waveform is 100V, a voltage of an address waveform is 70V, a voltage difference between the scan electrode (Y) and an address electrode (X1) becomes 100V in A area by the scan waveform first applied to the scan electrode (Y). If a time of "Δt" flows after an scan waveform is applied, a voltage difference between the scan electrode (Y) and the address electrode (X1) increases to 170V by the address waveform applied to the address electrode (X1).

Accordingly, a voltage difference between the scan electrode (Y) and the address electrode (X1) becomes an address discharge firing voltage and thus address discharge occurs between the scan electrode (Y) and the address electrode (X1).

Figure 10D:
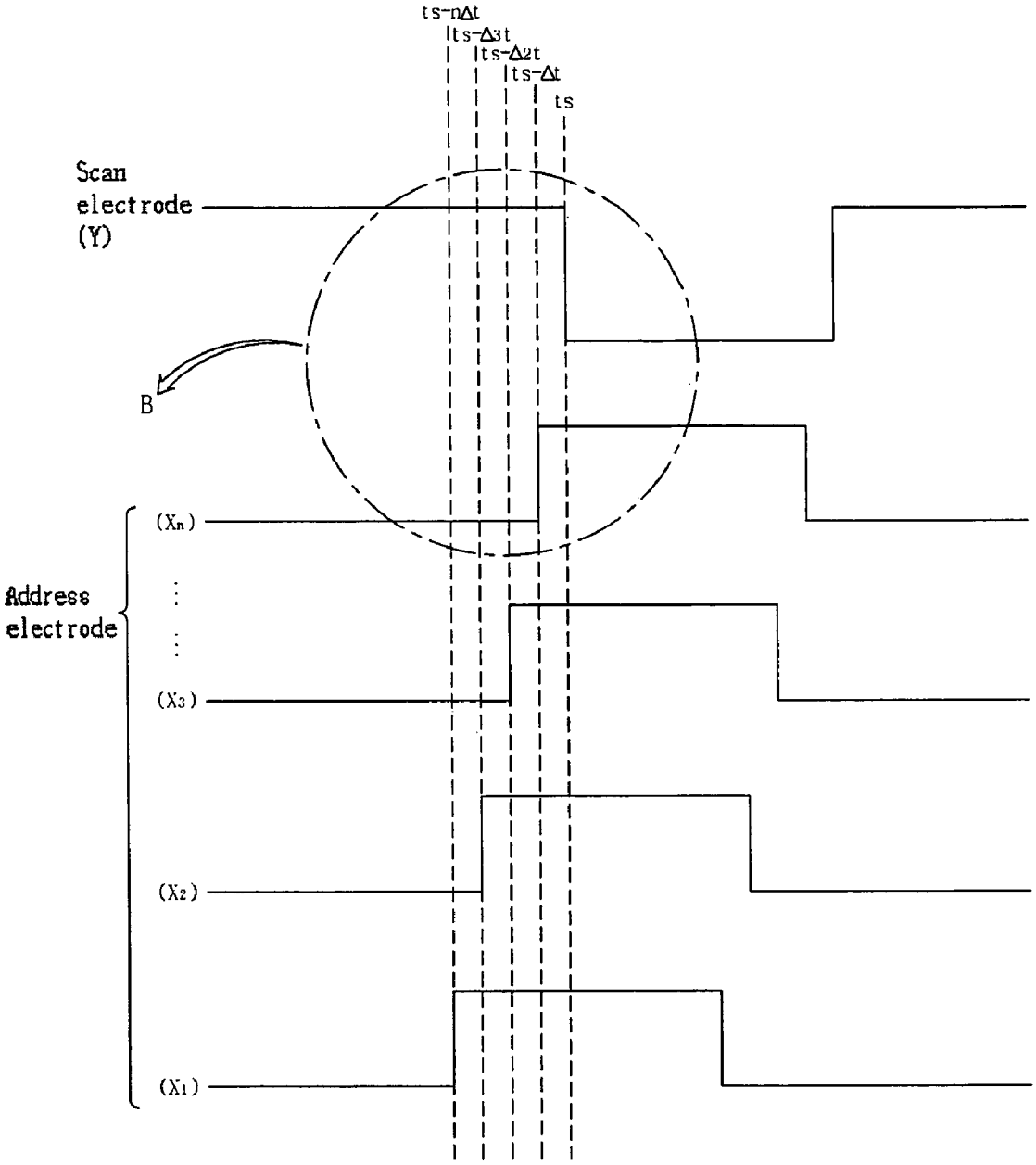

As shown in FIG. 10D, a driving waveform of the address period according to the second embodiment of the present invention is applied so that an applying time point of an address waveform applied to address electrodes (X1 to Xn) is earlier than an applying time point of the scan waveform applied to the scan electrode (Y).

Figure 10E:
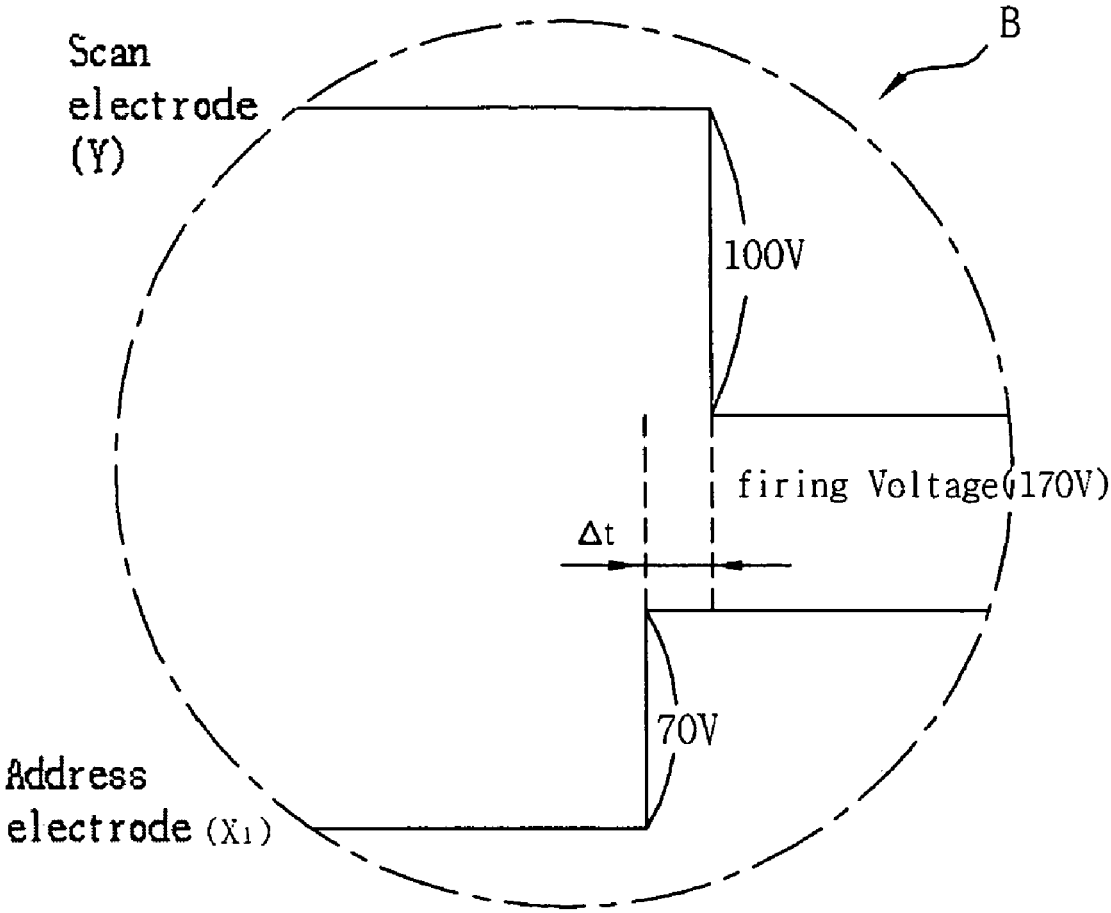

Area B of FIG. 10D will be described with reference to FIG. 10E. For example, if it is assumed that an address discharge firing voltage is 170V and a voltage of a scan waveform is 100V, a voltage of an address waveform is 70V, a voltage difference between the scan electrode (Y) and an address electrode (X1) becomes 70V in B area by the address waveform first applied to the address electrode (X1). If a time of "Δt" flows after the address waveform is applied, a voltage difference between the scan electrode (Y) and the address electrodes (X1 to Xn) increases to 170V by the scan waveform applied to the scan electrode (Y).

Accordingly, a voltage difference between the scan electrode (Y) and the address electrode (X1) becomes an address discharge firing voltage and thus address discharge occurs between the scan electrode (Y) and the address electrode (X1).

In FIGS. 10A to 10E, a time difference between an applying time point of the scan waveform applied to the scan electrode (Y) and that of an address waveform applied to address electrodes (X1 to Xn) or a difference between applying time points of address waveforms applied to address electrodes (X1 to Xn) is referred to as "Δt". The "Δt" will be described. It is assumed that an applying time point of the scan waveform applied to the scan electrode (Y) is "ts" and a time difference between an applying time point "ts" of the scan waveform and a difference between an applying time point "ts" of the scan waveform and that of an address waveform which is most proximate to an applying time point "ts" of the scan waveform is "Δt", and a difference between an applying time point "ts" of the scan waveform and that of an address waveform which is next proximate to an applying time point "ts" of the scan waveform is "2Δt".

The "Δt" is uniformly sustained. That is, differences between applying time points of address waveforms applied to each of address electrodes (X1 to Xn) are equal to each other while an applying time point of the scan waveform applied to the scan electrode (Y) and that of the address waveform applied to address electrodes (X1 to Xn) are set to be different from each other.

In addition, differences between an applying time point of each of scan waveforms and that of an address waveform which is most proximate to an applying time point of the scan waveform may be equal to or different from each other while differences between applying time points of address waveforms applied to each of address electrodes (X1 to Xn) are equal to each other within one subfield. That is, "Δt" according to the second embodiment of the present invention can be similarly used with "Δt" according to the first embodiment of the present invention.

Considering the limited address period, it is preferable that a difference between applying time points of address waveforms corresponding to one scan waveform is set to be from 10 ns to 1000 ns. In addition, considering any one scan waveform width according to driving of a plasma display apparatus, it is preferable that a difference between applying time points of address waveforms corresponding to one scan waveform is set to be from one-hundredth to one times greater than a predetermined width of a scan waveform.

Third Embodiment

Like the plasma display apparatus according to the first embodiment and the second embodiment of the present invention, a plasma display apparatus according to a third embodiment of the present invention comprises a plasma display panel, a data driver, a scan driver, and a sustain driver.

Unlike the plasma display apparatus according to the first embodiment and the second embodiment of the present invention, the plasma display apparatus according to the third embodiment of the present invention divides an address electrode into a plurality of electrodes and applies an address waveform corresponding to the scan waveform applied to the scan electrode depending on a panel capacitance to at least one address electrode group at a time point different from an applying time point of a scan waveform.

The panel capacitance means that a structure itself of a plasma display panel constitutes a capacitance with each electrode, a barrier rib partitioning a discharge cell, a dielectric layer formed in a front substrate, etc. That is, upon driving of a plasma display apparatus, as a predetermined voltage is supplied to each electrode of a plasma display panel, a panel capacitance is formed between electrodes and thus a displacement current is generated in each electrode. The displacement current allows a noise to generate in a driving waveform upon driving of the plasma display apparatus. That is, the panel capacitance according to the third embodiment of the present invention can mean a capacitance between scan electrodes and address electrodes. The capacitance can be measured from a whole plasma display panel or each of address electrode groups. Therefore, the number and an applying time point (whether it is earlier than or later than or not) of an address pulse corresponding to a scan pulse and having a different applying time point using a capacitance measured from each address electrode group may be determined in each address electrode group.

For this reason, in the third embodiment of the present invention, a fluctuation of a panel capacitance as an important factor determining an applying time point of the address waveform applied corresponding to a scan waveform is considered.

Figure 11:
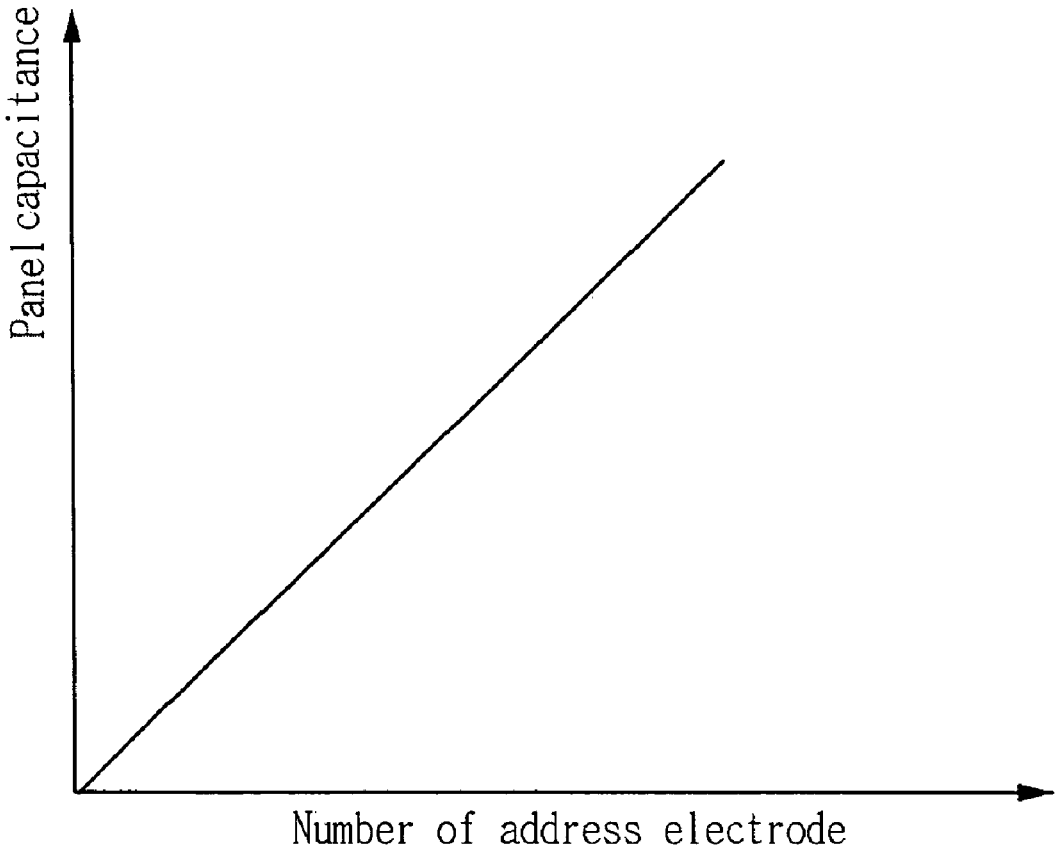
FIG. 11 illustrates a relationship of a panel capacitance to the number of an address electrode to which an address waveform is applied corresponding to a scan waveform.

FIG. 11 illustrates a relationship of a panel capacitance to the number of an address electrode to which an address waveform is applied corresponding to a scan waveform.

As shown in FIG. 11, as the number of address electrodes to which an address waveform is applied corresponding to the same scan waveform increases, a panel capacitance increases and as the number of address electrodes to which the address waveform is applied corresponding to the same scan waveform decreases, a panel capacitance decreases. A relationship of a panel capacitance to the number of address electrodes in which an address waveform is applied corresponding to the same scan waveform may be non-linear depending on a condition, unlike that shown in FIG. 11.

In the third embodiment of the present invention, an image signal data supplied to the data driver can be used with a method of detecting a fluctuation of such a panel capacitance. That is, in a discharge cell positioned in the same line in a horizontal direction, a fluctuation degree of a panel capacitance that is substantially appeared depending on the number of a discharge cell turned on in one subfield period can be seen. In the third embodiment of the present invention, a fluctuation of a panel capacitance can be detected with various methods besides such a method.

Figure 12:
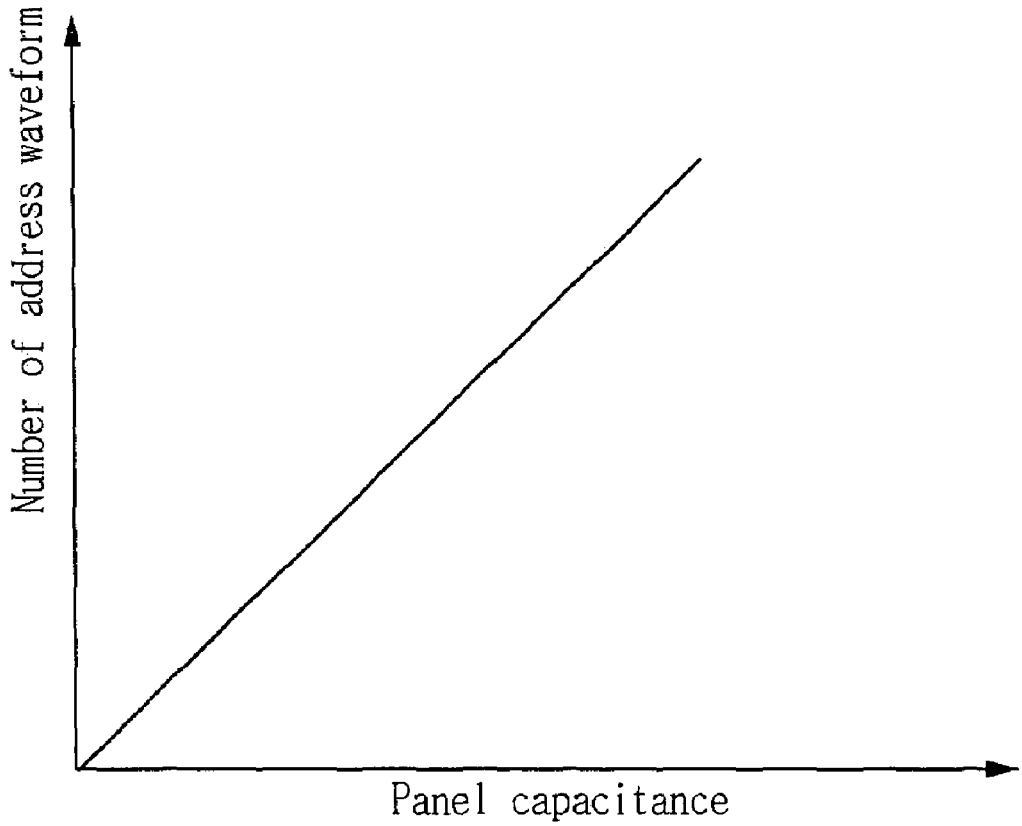
FIG. 12 illustrates a relationship between the applying time points of the address waveform to a panel capacitance according to a third embodiment of the present invention.

FIG. 12 illustrates a relationship between the applying time points of the address waveform to a panel capacitance according to a third embodiment of the present invention.

As shown in FIG. 12, in the third embodiment of the present invention, as a panel capacitance increases, the number of an address waveform earlier than or later than an applying time point of a scan waveform increases.

That is, in the third embodiment of the present invention, by detecting the increase of the panel capacitance, it can be seen that the number of an address waveform having different applying time points and corresponding to one scan waveform increases. As the number of an address waveform having different applying time points and corresponding to the same scan waveform increases, an address waveform applied at the same time as one scan waveform decreases and thus a noise can be decreased.

In addition, as a panel capacitance decreases, the number of address waveforms which are earlier than or later than an applying time point of a scan waveform can be decreased.

In FIG. 12, a relationship of the number of an address waveform earlier than or later than a value of a panel capacitance is shown in a linear curve, but it can be shown in a non-linear curve in a modified embodiment. For example, a predetermined threshold value can be preset and the number of address waveform in which a panel capacitance is earlier than or later than a threshold value can be determined.

On the other hand, in a case where a panel capacitance is greater than a predetermined threshold value, the panel capacitance can be earlier than most of address pulses having an applying time point different from a scan pulse and in a case where a panel capacitance is not greater than a threshold value, the panel capacitance can be later than most of address pulses having an applying time point different from a scan pulse. A predetermined threshold value may be set as not one value but a range.

On the other hand, as in the first embodiment and the second embodiment of the present invention, in the third embodiment of the present invention, an applying time point of an address waveform can be variously changed and thus a numerical value can be limited. Therefore, it is possible to reduce a noise generated in an address period upon driving of a plasma display apparatus.

Figure 13:
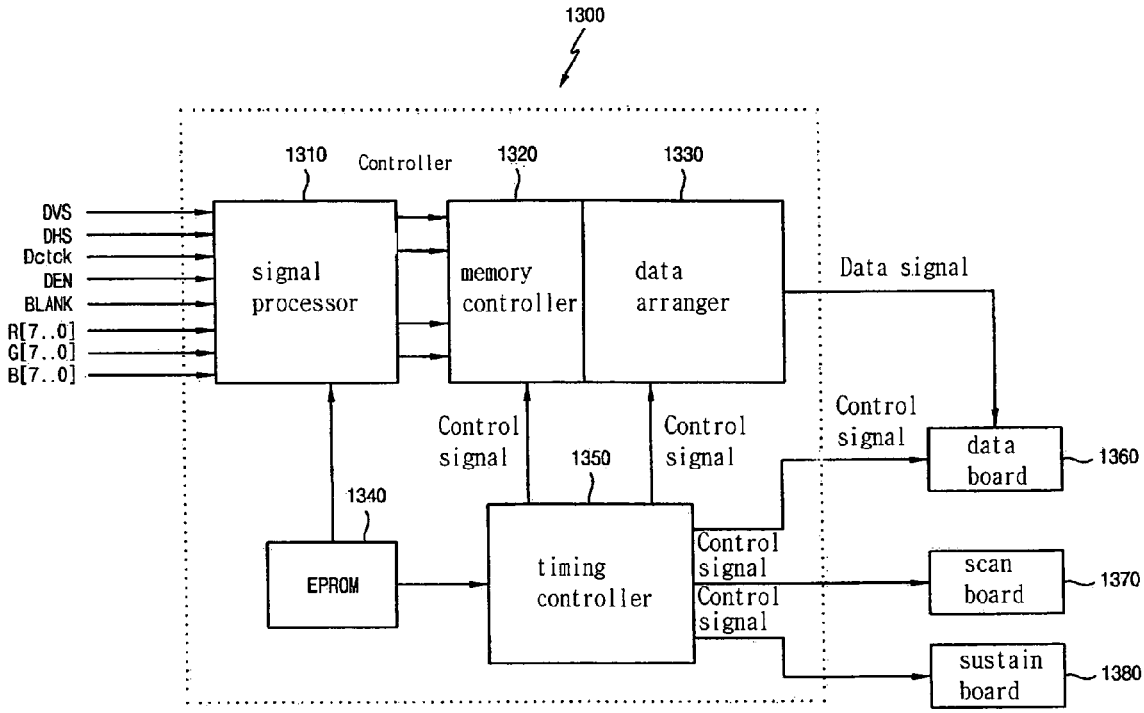
FIG. 13 illustrates a construction of a controller in the plasma display apparatus driving according to embodiments of the present invention.

FIG. 13 illustrates a construction of a controller in the plasma display apparatus driving according to the embodiment of the present invention.

As shown in FIG. 13, in general, a circuit module of a plasma display panel comprises a control board, a data board, a scan board, and a sustain board, etc. Specifically, the control board performs a central function controlling an operation of other boards and performs various functions such as a gamma processing, a gain processing, an error diffusion processing, an average picture level (APL) calculation, a subfield mapping (SFM) processing, and an operation timing processing of a data board, a scan board, and a sustain board.

A controller 1300 comprises a signal processor 1310, a memory controller 1320, a data aligner 1330, an erasable programmable ROM (EPROM) 1340, a timing controller 1350, etc as components to be mounted in the control board.

The signal processor 1310 receives a DVS signal, a DHS signal, a DEN signal, R, G, B signals, etc. and performs functions such as a gain processing, a subfield mapping processing, an error diffusion processing, an inverse gamma correction processing, APL calculation, etc.

The memory controller 1320 stores various signals inputted from the signal processor 1310 and processes a signal by controlling of the timing controller 1350.

The data aligner 1330 aligns various data pulses received from the memory controller 1320 and applies a data pulse arranged to the data board 1360 depending on a control signal inputted from the timing controller 1350.

The EPROM 1340 stores a scan table, a subfield mapping table, a timing table, an APL table, various parameters, etc. Therefore, the signal processor 1310 and the timing controller 1350 perform a desired operation using various tables stored in the EPROM 1340.

On the other hand, according to embodiments of the present invention, a timing table stored in the EPROM 1340 comprises a data pulse timing table for one or more data pulse applied to a data driver IC (not shown) mounted in the data board 1360 and a scan pulse timing table for a scan pulse applied to a scan driver IC (not shown). Information of an applying time point of a data pulse for an address electrode comprised in the two or more electrode groups and an applying time point of a scan pulse for the scan electrode is stored in the data pulse timing table stored in the EPROM 1340. That is, due to such a predetermined timing table, a data pulse is applied at a time point different from a scan pulse. In addition, an applying time point of a data signal of an electrode group unit comprised in the data pulse timing table has a value different from at least two address electrode groups different from an applying time point of a scan pulse.

On the other hand, information of an applying time point of each different data pulse for all address electrodes may be stored in the timing table. In this case, a data signal is applied to all address electrodes at each time point different from an applying time point of the scan pulse.

On the other hand, information of a difference between applying time points of a pulse may be stored in an information form of a difference between applying time points of a data pulse for each address electrode group or for each address electrode and a difference between an applying time point of a scan pulse and an applying time point of a data pulse and the difference between applying time points of the pulse has a value of 10 ns to 1000 ns. Furthermore, considering any one scan pulse width depending on driving the plasma display panel, it is preferable that "Δt" is set to have a range of one-hundredth to one times greater than a predetermined scan pulse width.

On the other hand, in FIG. 13, as a storage medium storing various tables comprising the data pulse timing table, the EPROM 1340 is exemplified, but a storage medium is not limited to this and a ROM type storage medium such as an EPROM ROM and a flash ROM can be used.

The timing controller 1350 reads information recorded in the data pulse timing table and the scan pulse timing table stored in the EPROM 1340 and generates a control signal for applying a scan pulse and a data pulse, and applies the generated control signal to the data aligner 1330. The data aligner 1330 generates a data pulse to apply data arranged depending on a control signal received from the timing controller 1350 and applies the data pulse to the data board 1360. Data pulses applied from data aligner 1330 are not simultaneously applied with scan pulses and are applied at a time point different from an applying time point of the scan pulse in at least two different time points.

Therefore, the data driver IC (not shown) mounted in the data board 1360 transmits the data pulse to a corresponding address electrode depending on the received order of the received data pulse and thus the data pulse is applied to the panel at a time point different from an applying time point of the scan pulse. Therefore, generating of a noise of a waveform applied to the scan board 1370 or the sustain board 1380 due to a panel coupling is reduced and thus address discharge is stabilized, so that it is possible to apply a single scan driving method.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel in which a plurality of scan electrodes and a plurality of address electrodes intersecting the scan electrodes are formed; and a data driver for setting the address electrodes to be divided into a plurality of address electrode groups and for applying a first address waveform to a first one of the address electrode groups, the first address waveform having a first applying time point during an address period that is earlier than an applying time point of a corresponding scan waveform applied to the scan electrode during the address period.

2. The plasma display apparatus of claim 1, wherein the data driver further applies a second address waveform to a second one of the address electrode groups, the second address waveform having a second applying time point during the address period that is later than the applying time point of the scan waveform during the address period.

3. The plasma display apparatus of claim 1, wherein a difference between the first applying time point of the address waveform and the applying time point of the corresponding scan waveform is from 10 ns to 1000 ns.

4. The plasma display apparatus of claim 1, wherein a difference between the first applying time point of the first address waveform corresponding to the scan waveform and a second applying time point of a second address waveform corresponding to the scan waveform is from one hundredth to one times greater than a width of the scan waveform.

5. The plasma display apparatus of claim 1, wherein a difference between the applying time point of the scan waveform and an applying time point of an address waveform that is most proximate to the applying time point of the scan waveform is from 10 ns to 1000 ns.

6. The plasma display apparatus of claim 1, wherein a difference between the applying time point of the scan waveform and an applying time point of an address waveform that is most proximate to the applying time point of the scan waveform is from one hundredth to one times greater than a width of the scan waveform.

7. The plasma display apparatus of claim 1, wherein the first address electrode group comprises at least one address electrode.

8. The plasma display apparatus of claim 1, wherein each of the plurality of address electrode groups separately comprise a same number of the address electrodes or at least one of the address electrode groups comprises a different number of address electrodes.

9. The plasma display apparatus of claim 1, wherein the data driver applies the first address waveform to all the address electrodes of the first address electrode group at a same time point.

10. The plasma display apparatus of claim 1, wherein a number of the plurality of address electrode groups is at least two and the number of the plurality of address electrode groups is a total number of the address electrodes or less than the total number of the address electrodes.

11. A plasma display apparatus comprising:

a plasma display panel in which a plurality of scan electrodes and a plurality of address electrodes intersecting the scan electrodes are formed; and a data driver for applying an address waveform to the address electrodes, wherein a scan waveform is applied to one scan electrode and an applying time point of the address waveform applied to the address electrodes corresponding to the scan waveform are earlier than an applying time point of the one scan electrode.

12. The plasma display apparatus of claim 11, wherein a difference between the applying time point of the address waveform corresponding to the one scan waveform and an applying time point of another address waveform corresponding to the one scan waveform is from 10 ns to 1000 ns.

13. The plasma display apparatus of claim 11, wherein a difference between the applying time point of the address waveform corresponding to the one scan waveform and another applying time point of another address waveform applied to other address electrodes corresponding to the one scan waveform is from one hundredth to one times greater than a width of the scan waveform.

14. The plasma display apparatus of claim 11, wherein the address electrodes are divided into a plurality of electrode groups and applying time points between address waveforms applied to one of the address electrode groups corresponding to the scan waveform are different from each other in at least one subfield of a frame.

15. A plasma display apparatus comprising:

a plasma display panel in which a plurality of scan electrodes and a plurality of address electrodes intersecting the scan electrodes are formed; and a data driver for dividing the address electrodes into a plurality of electrode groups and for applying an address waveform corresponding to a scan waveform applied to the scan electrode to a first one of the address electrode groups and the address waveform having an applying time point that is different from an applying time point of the scan waveform based on a panel capacitance, wherein the applying time point of the address waveform applied to the first one of the address electrode groups is earlier than the applying time point of the corresponding scan waveform.

16. The plasma display apparatus of claim 15, wherein the panel capacitance increases as a number of address electrodes to which the address waveform is applied increases corresponding to the scan waveform.

17. The plasma display apparatus of claim 16, wherein as the panel capacitance increases, the number of address waveforms earlier than or later than the applying time point of the scan waveform increases.

18. The plasma display apparatus of claim 15, wherein as a number of address electrodes to which the address waveform is applied corresponding to the scan waveform decreases, the panel capacitance decreases.

19. The plasma display apparatus of claim 18, wherein as the panel capacitance decreases, the number of address waveforms earlier than or later than the applying time point of the scan waveform decreases.

20. A driving method of a plasma display apparatus that embodies an image by applying a predetermined waveform to a plurality of scan electrodes and a plurality of address electrodes intersecting the scan electrodes, the method comprising:

dividing the address electrodes into a plurality of address electrode groups; and applying an address waveform corresponding to a scan waveform applied on the scan electrode to one of the address electrode groups, and the address waveform having an applying time point different than an applying time point of the scan waveform based on a panel capacitance, wherein the applying time point of the address waveform applied to the one of the address electrode groups is earlier than the applying time point of the corresponding scan waveform.

* * * * *